US006576089B1

(12) United States Patent
Sato et al.

(10) Patent No.: US 6,576,089 B1
(45) Date of Patent: Jun. 10, 2003

(54) PAPER MAKING MOLD FOR PULP MOLD MOLDING PRODUCTION AND METHOD AND DEVICE FOR PRODUCING PULP MOLD MOLDING

(75) Inventors: Atsushi Sato, Tochigi (JP); Akira Nonomura, Tochigi (JP); Shinji Kodama, Tochigi (JP); Naoki Imai, Yamagata (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/926,211

(22) PCT Filed: Mar. 24, 2000

(86) PCT No.: PCT/JP00/01821

§ 371 (c)(1),
(2), (4) Date: Jan. 2, 2002

(87) PCT Pub. No.: WO00/58556

PCT Pub. Date: Oct. 5, 2000

(30) Foreign Application Priority Data

| | | |
|---|---|---|
| Mar. 26, 1999 | (JP) | 11/83998 |
| Aug. 4, 1999 | (JP) | 11/221799 |
| Aug. 6, 1999 | (JP) | 11/224614 |
| Aug. 9, 1999 | (JP) | 11/225752 |
| Nov. 10, 1999 | (JP) | 11/319397 |

(51) Int. Cl.[7] ..... D21J 3/10; D21J 7/00

(52) U.S. Cl. ..... 162/227; 162/228; 162/397; 162/405; 425/358; 425/DIG. 14; 425/DIG. 44

(58) Field of Search ..... 162/115–117, 218–230, 162/387–416, 267; 264/40.3, 40.5, 86, 87, 299, 301, 306, 313, 315, 319; 425/357–362, 387.1, 388, 398–401, 412, 414, 416, 417, 419, 437, DIG. 14, DIG. 37, DIG. 44, DIG. 60, DIG. 119

(56) References Cited

U.S. PATENT DOCUMENTS

| | | | | | |
|---|---|---|---|---|---|
| 202,547 | A | * | 4/1878 | Hubbard | 162/405 |
| 504,730 | A | * | 9/1893 | Lane | 162/402 |
| 2,116,198 | A | * | 5/1938 | Hawley | 162/223 |
| 2,132,270 | A | * | 10/1938 | Nylander | 162/378 |

(List continued on next page.)

FOREIGN PATENT DOCUMENTS

| | | |
|---|---|---|
| GB | 468622 | 7/1937 |
| GB | 469882 | 8/1937 |
| JP | 5-279998 | 10/1993 |

OTHER PUBLICATIONS

U.S. patent application Ser. No. 09/503,083, Nonomura et al., filed Feb. 14, 2000, allowed.
U.S. patent application Ser. No. 09/622,040, Otakura et al., filed Aug. 23, 2000, allowed.
U.S. patent application Ser. No. 09/622,039, Kumamoto et al., filed Aug. 23, 2000, allowed.
U.S. patent application Ser. No. 09/622,043, Kumamoto et al., filed Oct. 10, 2000, pending.

(List continued on next page.)

*Primary Examiner*—Peter Chin
*Assistant Examiner*—Eric Hug
(74) *Attorney, Agent, or Firm*—Oblon, Spivak, McClelland, Maier & Neustadt, P.C.

(57) ABSTRACT

A papermaking mold for producing a pulp molded article comprising a core of prescribed shape which has a plurality of holes for fluid passage interconnecting the outside and the inside and is made of an elastically deformable material and a fluid-permeable material which covers the outer surface of the core, the fluid-permeable material being capable of forming passages for a fluid in its thickness direction even when pressed and deformed.

8 Claims, 19 Drawing Sheets

U.S. PATENT DOCUMENTS

| | | | | | |
|---|---|---|---|---|---|
| 2,363,107 | A | * | 11/1944 | Young | 425/389 |
| 2,417,375 | A | * | 3/1947 | Newbould | 162/401 |
| 2,565,949 | A | * | 8/1951 | Clifford et al. | 264/291 |
| 2,980,183 | A | * | 4/1961 | Wells | 162/416 |
| 4,702,870 | A | * | 10/1987 | Setterholm et al. | 264/87 |
| 5,277,854 | A | * | 1/1994 | Hunt | 264/86 |
| 5,876,835 | A | * | 3/1999 | Noble et al. | 428/156 |
| 5,900,119 | A | * | 5/1999 | Goers et al. | 162/218 |

OTHER PUBLICATIONS

U.S. patent application Ser. No. 09/673,667, Kumamoto et al., filed Jan. 5, 2001, pending.

U.S. patent application Ser. No. 09/713,230, Nonomura et al., filed Nov. 16, 2000, pending.

U.S. patent application Ser. No. 09/885,982, Kumamoto et al., filed Jun. 22, 2001, pending.

U.S. patent application Ser. No. 09/868,040, Otani et al., filed Jul. 23, 2001, pending.

U.S. patent application Ser. No. 09/889,566, Nonomura, filed Aug. 9, 2001, pending.

U.S. patent application Ser. No. 09/926,211, Sato et al., filed Jan. 2, 2002, pending.

U.S. patent application Ser. No. 09/926,690, Otani et al., filed Dec. 3, 2001, pending.

U.S. patent application Ser. No. 10/048,446, Otani et al., Feb. 4, 2002, pending.

U.S. patent application Ser. No. 10/110,715, Tojo, Apr. 15, 2002, pending.

* cited by examiner 1
2
3
4
5
5a
5b
5c
6
7
42

100
110
120
130
140

100
2
3

100
2
4

100
110
130
150a
150b
150

100
120
110
130
150
6
6a
6b 120
110
150
6
6a
6b 100
6
150b
150

6
150

300
360
370
3
2
4
4a
4b 300
360
5h
5
4
4a
4b
5a 300
360
4b
310
5h
5a 300
370
5b
310
4a
4b
5a 300
5a
6

300
360
6

5a
6

5
5
6

500
3
2
4

500
4

500
4

500
5
5
4

500
5
4
5

500
5
4
5

500
5
5
4

6
5
5

604a
610
610a
4a'
4

610
4
619

605
610
610a
641
626
4
621

605
610a
628
621
4

605
619
610
4
641
626
621

610
4

630
638
4
639
633

630
642
638
638a
4
633

6
633

641
640
633
639
6
640

PAPER MAKING MOLD FOR PULP MOLD MOLDING PRODUCTION AND METHOD AND DEVICE FOR PRODUCING PULP MOLD MOLDING

TECHNICAL FIELD

The present invention relates to a papermaking mold, with which pulp molded articles with excellent surface smoothness and a satisfactory appearance can easily be produced, and a method of producing pulp molded articles using the mold. The invention also relates to a papermaking mold, with which pulp molded articles of any desired shape can easily be produced, and a method of producing pulp molded article using the mold. The invention also relates to an apparatus for producing pulp molded articles.

BACKGROUND ART

A drying mold used to dry a water-containing molded article formed by a pulp molding method has passages for discharging water or steam out of the mold.

When a conventional drying mold is used, however, the projected traces of the passages are transferred to the surface of a molded article to impair the appearance of the molded article; some shapes of molded articles are liable to scratches when removed from the drying mold; or pulp fiber tends to adhere and accumulate in the passages so that the drying mold needs frequent cleaning.

According to JP-A-5-279998, a pulp component is deposited on a papermaking net, which is pressed by a pressing mold made of an elastic material and formed into the shape of a container and then hot-pressed by a press having the shape of a container to produce a molded article.

The pressing mold used in the above-described method is used only to press the pulp component and cannot be used for papermaking or dewatering. Therefore, the steps of from papermaking to shaping require a separate member for shaping, i.e., the above-mentioned pressing mold, in addition to a member for papermaking and dewatering. This makes the production process complicated. Further, it is difficult to make molded articles of complicated shape, for example, those having an undercut.

When the container precursor obtained by pressing the pulp component by the pressing mold is transferred to the press, the container precursor, being in intimate contact with the papermaking net, has poor releasability, which reduces production efficiency, and may be damaged in some manners of removing from the mold.

JP-A-7-223230 discloses a molding method using a mold composed of an inner mold and an outer mold, the inner mold having attached thereto a flexible membrane capable of being inflated to form substantially the same contour as the inner shape of a desired molded article, wherein a molding material is squeezed between the inner mold and the outer mold, and a fluid pressure is applied from a fluid pipe between the flexible membrane and the inner mold to inflate the flexible membrane. According to this method, however, because a fluid is supplied from one place between the flexible membrane and the inner mold, it is difficult to cause the molded article to elongate uniformly by pressing with the inflated flexible membrane. It tends to follow that the molded article suffers from cracks or thickness unevenness.

Apart from these methods, known apparatus for producing pulp molded articles include the one described in JP-A-8-232200, which is an apparatus for making a pulp molded article having a multilayer structure. The apparatus disclosed comprises a papermaking mold which reciprocates linearly and a plurality of feedstock tanks which are arranged along the travel of the papermaking mold.

In this apparatus, the papermaking mold successively travels starting from the first feedstock tank to carry out papermaking and completes papermaking at the final feedstock tank. After the molded article built up on the papermaking mold is shifted to a drying step, the papermaking mold returns to the first feedstock tank and repeats the reciprocating motion. Accordingly, the papermaking mold needs time to return back to the starting position, which means that a single papermaking cycle requires an extended time. This cannot be seen as highly productive.

In this apparatus, the molded article after the papermaking step is transferred directly to a drying mold composed of an outer mold and an inner mold, where the article is dewatered by suction. The shaped article before dewatering which is wet enough to be easily deformable must be handled, and positioning accuracy is hard to secure in transferring into the drying mold, unavoidably resulting in poor molding accuracy. In producing thin-walled articles, in particular, it often happens that the molded articles are broken when transferred. Thus, the apparatus is not applicable to production of thin-walled articles.

Additionally, it is impossible with the papermaking mold and the inner and outer molds for drying used in the above apparatus to make deep containers whose side walls stand at right angles or nearly right angles, containers whose neck is narrower than the body, and containers having a so-called undercut.

DISCLOSURE OF THE INVENTION

Accordingly, an object of the present invention is to provide a papermaking mold with which a pulp molded article having excellent surface smoothness and a satisfactory appearance can easily be obtained and a method of producing such a pulp molded article.

Another object of the present invention is to provide a papermaking mold with which a pulp molded article having a complicated shape can conveniently be obtained and a method of producing such a pulp molded article.

Still another object of the present invention is to provide a papermaking mold from which a molded article is removed satisfactorily to produce molded articles with good productivity and a method of producing a pulp molded article.

Yet another object of the present invention is to provide a papermaking mold with which a pulp molded article of desired shape can easily be produced without developing cracks or thickness unevenness and a method of producing a pulp molded article.

A further object of the present invention is to provide a papermaking mold with which a pulp molded article can be produced efficiently with high molding accuracy and a method of producing a pulp molded article.

A furthermore object of the present invention is to provide an apparatus for producing a pulp molded article with which a high production efficiency can be achieved.

A furthermost object of the present invention is to provide an apparatus for producing a pulp molded article with which deep containers whose side walls stand at right angles or nearly right angles, containers whose neck is narrower than the body, and containers having a so-called undercut can easily be produced.

The present invention accomplishes the above objects by providing a papermaking mold for producing a pulp molded article which comprises a core of prescribed shape made of an elastically deformable material and having a plurality of holes for fluid passage which interconnect the outside and the inside thereof and a fluid-permeable material covering the outer surface of the core, the fluid-permeable material being capable of securing passages for a fluid in its thickness direction even when pressed and deformed.

The present invention accomplishes the above objects by providing a papermaking mold for producing a pulp molded article which comprises a flat papermaking plate having a plurality of through-holes at a prescribed interval, an upper plate disposed above the papermaking plate, a number of cores each fixed to the lower side of the upper plate and fitted into each of the through-holes from the upper side of the papermaking plate, and a fluid-permeable material covering the lower side of the papermaking plate, wherein the papermaking plate has a plurality of holes for fluid passage which are open on the lower side thereof and interconnect the lower side and the inside of the papermaking plate, the core is made of an elastically deformable material and has a plurality of holes for fluid passages interconnecting the outside and the inside thereof, the upper plate is connected to the papermaking plate via a number of connecting guides in such a manner as to slide vertically and, as the upper plate slides, the core fixed to the lower side of the upper plate is removably fitted through each through-hole of the papermaking plate, and the fluid-permeable material is capable of forming fluid passages in the thickness direction thereof even when pressed and deformed.

The present invention accomplishes the above objects by providing a papermaking mold for producing a pulp molded article which comprises a core that is a rigid body of prescribed shape having a plurality of holes for fluid passage interconnecting the inside and the outside thereof, a core holding member that is positioned under the core and is made of an elastically deformable material, and a mesh member which closely covers the outer surface of the core holding member, wherein the core holding member has formed therein interconnecting holes open on the outer surface thereof, the interconnecting holes linking up with the holes for fluid passage formed in the core when the core holding member is disposed under the core.

The present invention accomplishes the above objects by providing a papermaking mold for producing a pulp molded article which comprises a main body made of an elastically deformable material and having inside a cavity of prescribed shape and a plurality of holes for fluid passage that lead the cavity to the outside, an expanding and contracting member which slides within the cavity in the height direction of the main body, and a mesh member closely covering the outer surface of the main body, wherein the expanding and contracting member has interconnecting holes which interconnect the inside and the outside thereof, and when the expanding and contracting member is slid down, the cavity is pushed wider to expand the main body through elastic deformation, and the interconnecting holes and the holes for fluid passage connect up with each other in at least the state before the sliding.

The present invention accomplishes the above objects by providing a method of producing a pulp molded article which comprises:

immersing a papermaking mold having interconnecting passages that interconnect the outside and the inside thereof and capable of elastic deformation in a pulp slurry, sucking up the water content in the pulp slurry from the outside to the inside of the papermaking mold through the interconnecting passages to form a pulp layer on the surface of the papermaking mold, fitting the papermaking mold having the pulp layer formed thereon into an impression of a female mold that is shaped in conformity with the contour of a molded article in such a manner that the base of the pulp layer is the first to come into contact with the bottom of the female mold, pressing and deforming the papermaking mold in conformity with the shape of the impression thereby to transfer the shape of the impression onto the pulp layer and to discharge the water content of the pulp layer outside the papermaking mold through the inside of the papermaking mold.

The present invention accomplishes the above objects by providing a method of producing a pulp molded article which comprises:

immersing a papermaking mold having interconnecting passages that interconnect the outside and the inside thereof and capable of elastic deformation in a pulp slurry, sucking up the water content in the pulp slurry from the outside to the inside of the papermaking mold through the interconnecting passages to form a pulp layer on the surface of the papermaking mold, fitting the papermaking mold having the pulp layer formed thereon into an impression of a female mold, the impression being shaped in conformity with the contour of a molded article, the upper side of the impression being covered with an extensible sheet that is fixed to the periphery of the impression, while deforming the extensible sheet by extension so that the base of the pulp layer is brought into contact with the bottom of the impression via the extensible sheet, and pressing and deforming the papermaking mold in conformity with the shape of the impression thereby to transfer the shape of the impression onto the pulp layer to make a molded article.

The present invention accomplishes the above objects by providing a method of producing a pulp molded article which comprises:

immersing a papermaking mold having interconnecting passages that interconnect the outside and the inside and capable of expansion and contraction in a pulp slurry, with the papermaking mold being adjusted to a prescribed size, to form a pulp layer on the surface of the papermaking mold, contracting the papermaking mold to contract the pulp layer to a prescribed size, fitting the contracted pulp layer into the impression of a female mold composed of a set of splits, and expanding the pulp layer as fitted into the impression by a prescribed means to press the pulp layer onto the inner wall of the impression for dewatering.

The present invention accomplishes the above objects by providing an apparatus for producing a pulp molded article which comprises a papermaking mold having a papermaking part, a papermaking station having a liquid tank containing a pulp slurry, a dewatering station where a pulp layer formed on the outer surface of the papermaking part of the papermaking mold is dewatered by pressing, and a transfer station where the pressed and dewatered pulp layer is transferred to a subsequent station, wherein the papermaking part of the papermaking mold has a core which is capable of elastic deformation under pressing, the dewatering station has a dewatering female mold having an impression in which the papermaking part of the papermaking mold is to be fitted, the impression of the dewatering female mold being made larger than the shape of the papermaking part of the papermaking mold, and the papermaking station, the dewatering station, and the transfer station are arranged in this order on prescribed positions in an orbit, and the papermaking mold moves from station to station to revolve in the orbit.

BRIEF DESCRIPTION OF THE DRAWINGS

FIG. 2(*b*), the step of pulling up the papermaking mold; FIG. 2(*c*), the step of fitting the papermaking mold into a female mold; FIG. 2(*d*), the step of pressing the papermaking mold; FIG. 2(*e*), the step of removing the papermaking mold; and FIG. 2(*f*), the step of removing a molded article.

FIG. 3(*b*), the step of pulling up the papermaking mold; FIG. 3(*c*), the step of fitting the papermaking mold into a female mold; FIG. 3(*d*), the step of pressing the papermaking mold into the female mold; FIG. 3(*e*), the step of pressing the papermaking mold; and FIG. 3(*f*), the step of removing the papermaking mold and a molded article.

FIG. 9(*b*) is a plan view of FIG. 9(*a*); FIG. 9(*c*) shows vertical movement; FIG. 9(*d*) is a plan view of FIG. 9(*c*); FIG. 9(*e*) shows horizontal movement; and FIG. 9(*f*) is a plan view of FIG. 9(*e*).

FIG. 10(*b*), a pulp layer being transferred to a dewatering mold; FIG. 10(*c*), a core and a fluid-permeable material separated from each other; FIG. 10(*d*), the step of dewatering; FIG. 10(*e*), completion of the step of dewatering; FIG. 10(*f*), the step of removing the pulp layer from the dewatering mold; FIG. 10(*g*), the pulp layer placed in a drying mold; FIG. 10(*h*), the step of drying; FIG. 10(*i*), the fluid-permeable material being removed; and FIG. 10(*j*), the step of removal from the mold.

FIG. 13(*b*), the step of papermaking; FIG. 13(*c*), the step of pulling up the papermaking mold; FIG. 13(*d*), the step of fitting into a female mold; FIG. 13(*e*), the step of pressing the papermaking mold; FIG. 13(*f*), the step of removing the core; FIG. 13(*g*), the step of removing the papermaking mold; and FIG. 13(*h*), the step of removing a molded article.

FIG. 15(*b*), the step of pulling up the papermaking mold; FIG. 15(*c*), the step of fitting the papermaking mold into a female mold; FIG. 15(*d*), the step of pressing the papermaking mold; FIG. 15(*e*), the step of removing the papermaking mold; and FIG. 15(*f*), the step of removing a molded article.

FIG. 17(*b*), the step of fitting the papermaking mold into a female mold; FIG. 17(*c*), the step of pushing an expanding and contracting member; FIG. 17(*d*), the step of pressing the papermaking mold; FIG. 17(*e*), the step of relieving the papermaking mold from being pressed; FIG. 17(*f*), the step of withdrawing the expanding and contracting member; FIG. 17(*g*), the step of removing the papermaking mold; and FIG. 15(*h*), the step of removing a molded article.

FIG. 22(*b*), the step of pulling up the papermaking mold; FIG. 22(*c*), the step of contracting the papermaking mold; FIG. 22(*d*), the step of fitting the papermaking mold into a female mold for shaping; FIG. 22(*e*), the step of expanding the papermaking mold; FIG. 22(*f*), the step of contracting the papermaking mold; FIG. 22(*g*), the step of removing the papermaking mold; and FIG. 22(*h*), the step of opening the shaping female mold.

FIG. 26(*b*), the step of pulling up the papermaking mold; FIG. 26(*c*), the step of fitting the papermaking mold into a female mold for dewatering; FIG. 26(*d*), the step of pressing the papermaking mold; FIG. 26(*e*), the step of pulling up the papermaking mold; FIG. 26(*f*), the step of transferring the papermaking mold; FIG. 26(*g*), the step of fitting a pulp layer into a female mold for drying; FIG. 26(*h*), the step of drying the pulp layer; FIG. 26(*i*), the step of relieving a molded article from the sandwiched state; and FIG. 26(*j*), the step of removing the molded article from the mold.

BEST MODE FOR CARRYING OUT THE INVENTION

Figure 1:
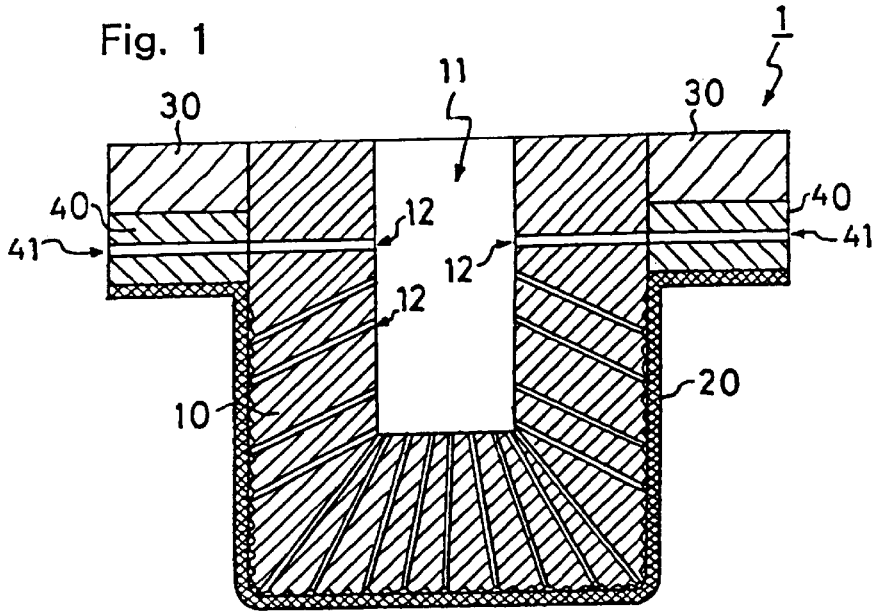
FIG. 1 is a vertical cross-section of a papermaking mold for producing a pulp molded article according an embodiment of the present invention.

The present invention will be described based on its preferred embodiments with reference to the accompanying drawings. FIG. 1 shows a vertical cross-section of a papermaking mold for producing a pulp molded article according an embodiment of the present invention. The papermaking mold 1 of the present embodiment, which is used to make box type moldings having an opening, comprises a core 10, a fluid-permeable material 20 covering the outer surface of the core 10, an extension 30 extending horizontally from the upper side of the core 10, and a flange 40 made of a rigid material which surrounds the sides of the core 10 and extends horizontally in the upper part of the core 10 and right under the extension 30.

The core 10 has a contour slightly smaller than the contour of an article to be molded with its height made larger than the height (depth) of the article. The core 10 is made of an elastically deformable material. Such a material includes rubbery materials, e.g., silicone rubber, flexible rubber, and urethane rubber. The core 10 has an open space in the upper central portion thereof to provide a hollow chamber 11. When the papermaking mold 1 is used, a suction pipe (not shown) is connected to the upper side of the hollow chamber 11 as will be shown in FIG. 2. The suction pipe is connected to a suction means (not shown), such as a vacuum pump. The sides and the base which constitute the outer surface of the core 10 have an uneven mesh pattern.

A plurality of interconnecting fluid passages 12 which interconnect the hollow chamber 11 to the outside of the core 10 are formed on the inner side of the hollow chamber 11. The interconnecting fluid passages 12 radiate out from the hollow chamber 11 toward the outside of the core 10. The interconnecting fluid passages 12 are open to the outside of the core 10. The number of the openings on the outer surface of the core 10 is preferably 1 to 4, particularly 1 to 2, per $cm^2$, for achieving efficiency in dewatering a pulp layer and securing sufficient strength of the core 10 while the core 10 is elastically deformed to press a pulp layer as hereinafter described.

The cross-sectional area of each fluid passage 12 is such that a fluid may not be prevented from passing through when the core 10 is pressed and deformed elastically.

In the papermaking mold 1 in an assembled state, the hollow chamber 11, the holes for fluid passage 12 and the fluid-permeable material 20 are united to provide passages interconnecting the outside and the inside of the papermaking mold 1.

The fluid-permeable material 20 covers all the sides and the base constituting the outer surface of the core 10 in close contact along the contour. Since the outer surface of the core 10 has an uneven mesh pattern as previously stated, a prescribed space is left between the fluid-permeable material 20 and the outer surface of the core 10 even with the fluid-permeable material 20 intimately covering the outer surface of the core 10. The fluid-permeable material 20 also covers the lower side of the flange 40. Therefore, in a papermaking step hereinafter described pulp fiber is accumulated on all the sides and the base of the core 10 and on the lower side of the flange 40.

The fluid-permeable material 20 is made of a extensible and contractible material that can be deformed following the elastic deformation of the core 10. The fluid-permeable material 20 is capable of forming passages for a fluid in its thickness direction, the passages serving for discharging water and steam from a pulp layer out of the papermaking mold 1 in dewatering and drying the pulp layer as hereinafter described. Therefore, it is necessary for the passages to let a fluid pass through without being collapsed even when the papermaking mold I is pressed and, as a result, the fluid-permeable material 20 is pressed and deformed. In this respect, it is preferable that the fluid-permeable material 20 be thick and elastic and be made of a material letting a fluid pass through. Specifically, the fluid-permeable material 20 preferably has a thickness of 0.1 to 10 mm, particularly 1 to 3 mm, in the state covering the outer surface of the core 10 and preferably has an extension of 5 to 50%, particularly 10 to 30%, in its state covering the outer surface of the core 10.

The fluid-permeable material 20 also functions as a papermaking net in forming a pulp layer. Accordingly, the fluid-permeable material 20 has such a mesh that allows water of a pulp slurry to pass but does not allow pulp fiber to pass. In order to secure pulp layer forming properties while preventing clogging with pulp fiber, the mesh size is preferably 20 to 100 mesh, particularly 40 to 60 mesh. From the standpoint of water absorbing properties, air permeability and strength, it is preferred for the fluid-permeable material 20 to have an average open area ratio of 10 to 80%, particularly 20 to 40%, in its state intimately covering the outer surface of the core 10.

From all these considerations, preferred materials as the fluid-permeable material 20 include knitted webs, woven fabrics and non-woven fabrics. Knitted webs are particularly preferred for their extensibility.

The extension 30 is rectangular in its plan view. It is made of an elastically deformable material similarly to the core 10. The material making the extension 30 and that making the core 10 may be the same or different. The extension 30 may be either one extending outward and horizontally from the upper part of the core 10 or a separate member fixed to the upper part of the core 10 by a prescribed means.

The flange 40 is rectangular and has the same contour as the extension 30 in its plan view. The flange 40 has an opening equivalent to the transverse section of the core 10. In papermaking mold 1 assembly, the core 10 is inserted through the opening of the flange 40, the flange 40 is lifted to bring its upper side into contact with the lower side of the extension 30, and the flange 40 is fixed to the extension 30 with a prescribed means.

The flange 40 has a through-hole 41 in its planar direction. The through-hole 41 leads to a fluid passage 12 made through the core 10. On use of the papermaking mold 1, the through-hole 41 is connected to a suction means (not shown), such as a vacuum pump.

The flange 40 is constituted of a rigid substance such as metal, ceramics and resins so that it undergoes no substantial deformation under external force application, which will provide a flanged molded article having a good finish on its flange as described later.

Figure 2:
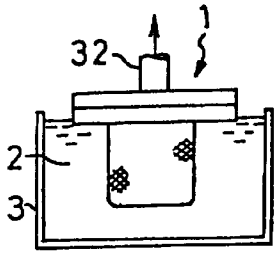
FIGS. 2(*a*) to 2(*f*) schematically illustrate the steps involved in a method for producing a pulp molded article by use of the papermaking mold shown in FIG. 1, in which FIG. 2(*a*) shows the step of papermaking.
Figure 2:
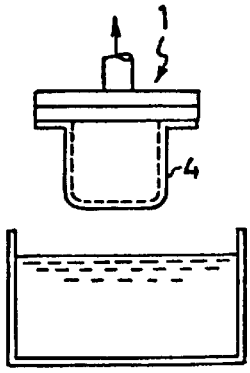
Figure 2:
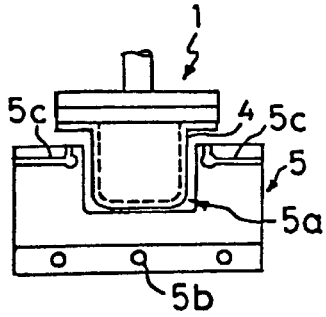
Figure 2:
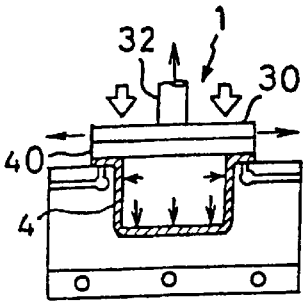
Figure 2:
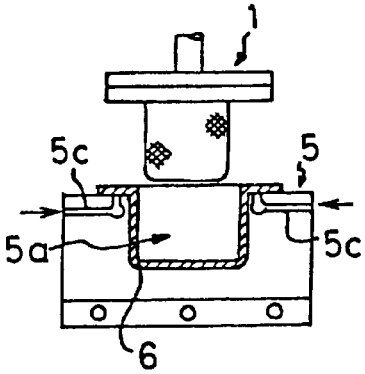
Figure 2:
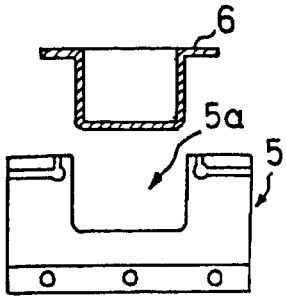

A method of producing a pulp molded article by use of the papermaking mold 1 shown in FIG. 1 is then described. FIGS. 2(*a*) to 2(*f*) schematically illustrate the steps involved in the method for producing a pulp molded article by use of the papermaking mold shown in FIG. 1. Specifically, FIG. 2(*a*) shows the step of papermaking; FIG. 2(*b*), the step of pulling up the papermaking mold; FIG. 2(*c*), the step of fitting the papermaking mold into a female mold; FIG. 2(*d*), the step of pressing the papermaking mold; FIG. 2(*e*), the step of removing the papermaking mold; and FIG. 2(*f*), the step of removing a molded article.

To begin with, the papermaking mold 1 is put in a container 3 filled with a pulp slurry 2. While the papermaking mold 1 is immersed in the pulp slurry 2, the inside of the papermaking mold 1 is evacuated through the above-mentioned passages by means of a suction means (not shown) such as a vacuum pump connected to a suction pipe 32 which leads to the hollow chamber 11 (see FIG. 1) of the papermaking mold 1. While the water content of the pulp slurry 2 is sucked up through the passages, pulp fibers are accumulated on the surface of the papermaking mold 1, i.e., the surface of the fluid-permeable material 20 to form a wet pulp layer. Since there is a prescribed space between the outer surface of the core 10 and the fluid-permeable material 20 to secure a water current as stated above, the pulp fibers are smoothly accumulated to form a pulp layer having a uniform thickness. Besides being made of an elastically deformable material as described above, the core 10 desirably has such stiffness as not to be deformed by this sucking.

The pulp slurry 2 comprises pulp fiber and water and, if desired, additionally contains other components such as inorganic substances, e.g., talc and kaolinite, inorganic fibers, e.g., glass fiber and carbon fiber, powder or fiber of synthetic resins, e.g., polyolefins, non-wood or plant fibers, and polysaccharides. The amount of these other components is preferably 1 to 70% by weight, particularly 5 to 50% by weight, based on the total of the pulp fiber and the components. The pulp fiber is preferably wood pulp of soft woods, hard woods, etc. and non-wood pulp of bamboo, straw, etc. The pulp fiber preferably has a length of 0.1 mm to 10 mm and a thickness of 0.01 mm to 0.05 mm.

After formation of a pulp layer to a prescribed thickness, the papermaking mold 1 is pulled out of the pulp slurry as shown in FIG. 2(*b*). Suction is continued to dewater the pulp layer 4 to a prescribed water content. A preferred water content of the pulp layer 4 after the dewatering by suction is 60 to 95% by weight, particularly 60 to 80% by weight, which is favorable for sufficiently holding the pulp layer 4 onto the surface of the papermaking mold 1 by suction and for carrying the papermaking mold 1 while preventing the pulp layer 4 held thereon from falling off.

After the pulp layer 4 is dewatered by suction to a prescribed water content, the papermaking mold 1 having the pulp layer 4 formed thereon is fitted into an open impression 5*a* of a female mold 5 as shown in FIG. 2(*c*), the impression 5*a* corresponding to the outer contour of a molded article to be produced, where the pulp layer 4 is dewatered by pressing, shaped, and dried by heating. While the female mold 5 used in this embodiment is composed of a single member, two or more splits can be combined to make the female mold in accordance with the configuration of a desired molded article, for example, a complicated configuration or a configuration having an undercut.

The female mold 5 has previously been heated to a prescribed temperature by a heating means 5*b*, such as an electrical heater. The inner surface of the impression 5*a* of the female mold 5 is smooth having no passages for discharging the water content from the pulp layer 4, i.e., water and steam. Blow-off ports 5*c* are provided on the surface of the female mold 5 on which a molded article is formed (in this embodiment on the peripheral area surrounding the impression 5*a* of the female mold 5). The blow-off ports 5*c* lead to an air supply source (not shown).

The pulp layer 4 is fitted in such a manner that its base is the first to come into contact with the bottom of the impression 5*a* of the female mold 5. Then, the papermaking mold 1 is pressed under a prescribed pressure as shown in FIG. 2(*d*). In this pressing, the extension 30 of the papermaking mold 1 is pressed by a prescribed means. Made of an elastically deformable material as stated previously, the extension 30 is pressed down to press the core 10 uniformly.

By this pressing, the core 10 of the papermaking mold 1 is pressed and deformed to the shape of the impression 5*a* of the female mold 5 to completely fill the space of the impression 5*a*. As a result, the pulp layer 4 formed on the surface of the papermaking mold 1 is further pressed and dewatered and, at the same time, the inner side configuration of the impression 5*a* is transferred onto the pulp layer 4. The pulp layer formed on the lower side of the flange 40 of the papermaking mold 1 is pressed between that side and the upper side of the female mold 5 and becomes a flange of the resulting molded article. Made of a rigid material as mentioned above, the flange 40 undergoes substantially no deformation in this pressing so that the pressing is done in this portion uniformly and effectively to give a good finish to the flange.

While the papermaking mold 1 is held in the pressed state, the inside of the papermaking mold 1 is evacuated through the suction pipe 32. As mentioned above, the passages of the fluid-permeable material 20 disposed on the outer surface of the papermaking mold 1 are capable of allowing a fluid to pass through without being collapsed even when the papermaking mold 1 is in the pressed state. Water contained in the pulp layer 4 is thus drained out of the papermaking mold 1 by the suction through the passages and the inside of the core 10 (i.e., the interconnecting fluid passages 12 and the hollow chamber 11 of the core 10). Steam generated by the pulp layer 4's drying is also discharged out of the papermaking mold 1 through the same route. While not shown, suction is also effected through the through-holes 41 (see FIG. 1) made in the flange 40, which further accelerates dewatering and drying of the pulp layer 4.

The papermaking mold 1 is kept in the pressed state for a prescribed time until the pulp layer 4 dries to provide a desired pulp molded article. The pressing of the papermaking mold 1 is then stopped, whereby the core 10 of the papermaking mold 1 returns to its original configuration before being pressing as shown in FIG. 2(*e*), while the resulting pulp molded article 6 is separated from the surface of the papermaking mold 1 and left in the impression 5*a* of the female mold 5. The papermaking mold 1 is then removed from the molded article 6. After the removal of the papermaking mold 1, air is blown toward the molded article 6 from the surface of the female mold 5 on which the molded article 6 has been formed (in this embodiment on the peripheral area surrounding the impression 5*a* of the female mold 5) through the blow-off ports 5*c*. A gap is thereby produced between that surface and the outer surface of the molded article 6 to release the molded article 6 from the female mold 5. The pulp molded article 6 is removed from the impression 5*a* as shown in FIG. 2(*f*).

The pulp molded article 6 thus produced is a hollow article of box shape with an opening and a flange extending outward from the periphery of the opening.

According to the above embodiment, since the female mold 5 has no air passages for discharging water and steam out of the mold, the pulp molded article 6 has a smooth surface, presenting an extremely good appearance. Further, since the flange of the molded article is formed by pressing between the lower side of the flange 40, which is made of a rigid material, and the upper side of the female mold 5, the resulting flange has a satisfactory finish. Furthermore, when the molded article 6 is taken out of the female mold 5, release of the molded article 6 from the female mold 5 is extremely smooth by the aid of air blown off from the molding surface of the mold toward the molded article 6.

Figure 3:
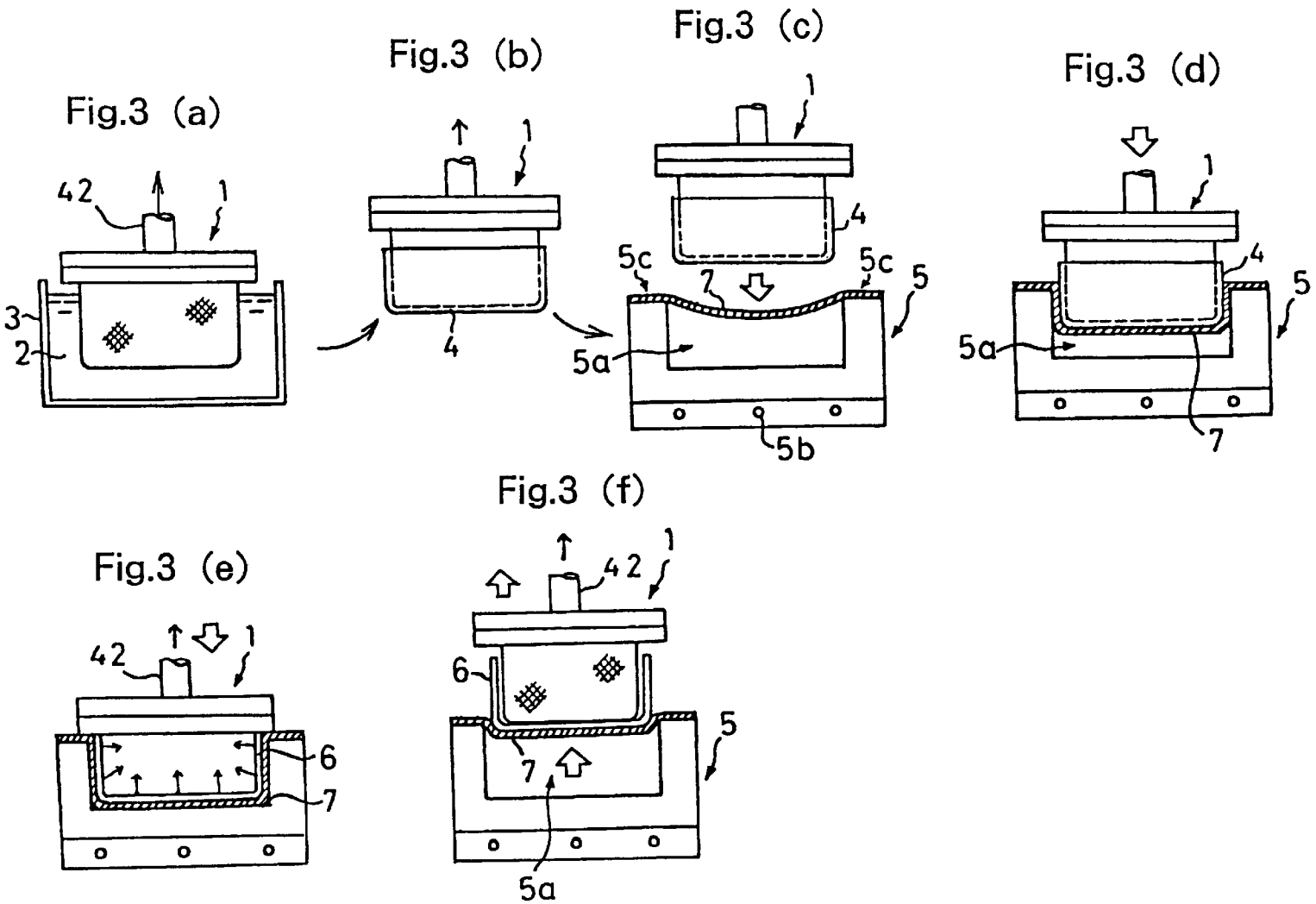
FIGS. 3(*a*) through 3(*f*) schematically illustrate the steps involved in another method of producing a pulp molded article by use of the papermaking mold shown in FIG. 1, in which FIG. 3(*a*) shows the step of papermaking.

Another method of producing a pulp molded article by use of the papermaking mold 1 shown in FIG. 1 is then described. FIGS. 3(*a*) through 3(*f*) schematically illustrate the steps involved in the pulp molded article production method according to this embodiment. Specifically, FIG. 3(*a*) shows the step of papermaking; FIG. 3(*b*), the step of pulling up the papermaking mold; FIG. 3(*c*), the step of fitting the papermaking mold into a female mold; FIG. 3(*d*), the step of pressing the papermaking mold into the female mold; FIG. 3(*e*), the step of pressing the papermaking mold; and FIG. 3(*f*), the step of removing the papermaking mold and a molded article. The explanation about the embodiment shown in FIGS. 1 and 2 applies appropriately to particulars not referred to in the present embodiment.

As shown in FIG. 3(*a*), the papermaking mold 1 is put into a container 3 filled with a pulp slurry 2. A water-containing pulp layer is formed by accumulating pulp fiber on the surface of the fluid-permeable material 20.

After a pulp layer is formed to a prescribed thickness, the papermaking mold 1 is pulled out of the pulp slurry as shown in FIG. 3(*b*), and the suction is continued to dewater the pulp layer 4 to a prescribed water content.

On suction-dewatering the pulp layer 4 to a prescribed water content, the papermaking mold 1 having the pulp layer 4 formed thereon is fitted into an open impression 5*a* of a female mold 5 as shown in FIG. 3(*c*), the impression 5*a* corresponding to the outer contour of a molded article to be produced, where the pulp layer 4 is dewatered by pressing, shaped, and dried by heating.

The impression 5*a* of the female mold 5 is covered with an extensible and contractible sheet 7. The sheet 7 is fixed to the whole area of the peripheral portion 5*c* or at diagonally facing two positions or more positions of the peripheral portion 5*c* of the impression 5*a* with a prescribed means. The material constituting the sheet 7 is not particularly limited as long as the sheet has prescribed extensibility and contractibleness. For example, knitted webs, woven fabrics and non-woven fabrics can be used as the sheet 7 in view of their fluid permeability. Knitted webs are particularly preferred for their sufficient extensibility.

The extensibility of the sheet 7 is preferably such that the elongation at break is about 200% at the most. Within the range, the stress at 10% or 20% elongation is preferably 500 to 5000 Pa, particularly 500 to 1000 Pa, which is advantageous in that the pulp layer 4 is not damaged when fitted into the impression 5*a* and that a molded article easily separates from the impression 5*a* when the papermaking mold 1 is taken out of the impression 5*a*.

The inner surface of the impression 5*a* of the female mold 5 is smooth with no vent holes for discharging water or steam generated from the pulp layer 4. Thus, by using a smooth sheet or a fine mesh sheet as the sheet 7, there is obtained a molded article with an extremely smooth surface and a very good appearance.

The papermaking mold 1 is fitted into the impression 5*a* while extending and deforming the sheet 7 as shown in FIG. 3(*d*). The height of the core 10 of the papermaking mold 1 being larger than the height (or depth) of a molded article, further pressing of the papermaking mold 1 into the impression 5*a* first results in contact of the base of the pulp layer 4 with the bottom of the impression 5*a*. Then, the papermaking mold 1 is further pressed down as shown in FIG. 3(*e*), whereby the core 10 of the papermaking mold 1 is pressed, deformed and expanded to the shape of the impression 5*a* of the female mold 5 to completely fill the space in the impression 5*a*. As a result, the pulp layer 4 formed on the surface of the papermaking mold 1 is further pressed and dewatered, and, at the same time, the inner configuration of the impression 5*a* is transferred onto the pulp layer 4.

With the papermaking mold 1 kept in the pressed state, water present in the pulp layer 4 is discharged out of the papermaking mold 1 through the passages in the fluid-permeable material 20 and the interconnecting fluid passages 12 formed in the core 10.

The papermaking mold 1 is kept in the pressed state for a prescribed time until the pulp layer 4 dries to provide a desired pulp molded article 6. The pressing of the papermaking mold 1 is then stopped, whereby the core 10 of the papermaking mold 1 returns to its original configuration before being pressed as shown in FIG. 3(*f*), and the resulting pulp molded article 6 separate from the sides of the papermaking mold 1. The papermaking mold 1 is lifted while evacuating the inside of the papermaking mold 1 from the outside thereof through the suction pipe 42 to keep the molded article 6 attracted to the base of the papermaking mold 1. As the papermaking mold 1 is lifted, the extended sheet 7 contracts, so that the molded article 6 spontaneously separates from the impression 5*a* and can be removed from the female mold 5 with ease.

According to the present embodiment, the production efficiency is greatly improved because the pulp molded article 6 shaped in the impression 5*a* of the female mold 5 can be released from the impression 5*a* with extreme ease. Further, the pulp molded article 6 is effectively prevented from being damaged when released. By use of a smooth sheet or a fine mesh sheet as the sheet 7, the surface of the pulp molded article 6 is made smooth to present an extremely good appearance.

Figure 4:
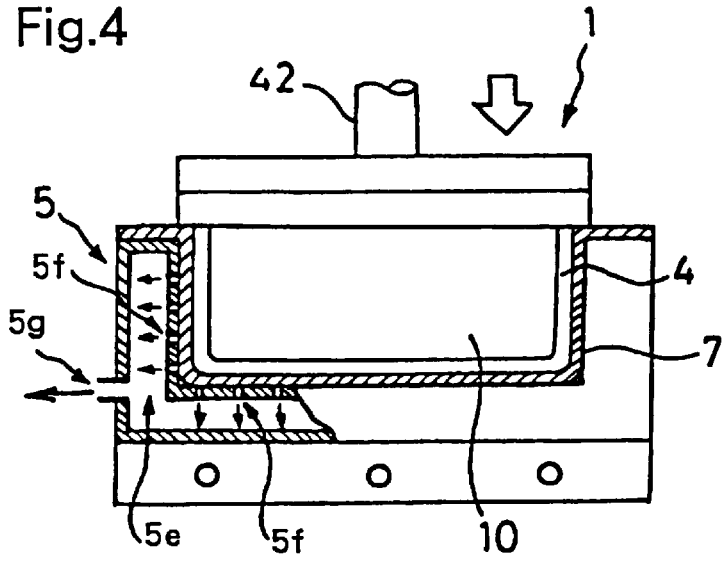
FIG. 4 shows a modification of the embodiment shown in FIGS. 3(*a*) to 3(*f*) and corresponds to FIG. 3(*e*).

A modification of the embodiment shown in FIGS. 3(*a*) to 3(*f*) will be described along with FIG. 4. FIG. 4 corresponds to FIG. 3(*e*). The modification is explained only with reference to the difference from the embodiment shown in FIGS. 3(*a*) to 3(*f*).

As shown in FIG. 4, the female mold 5 used in this embodiment has a hollow part 5*e* in the inside thereof, and a large number of vent holes 5*f* for discharging water and steam generated from the pulp layer 4 are formed on the inner surface of the impression 5*a*. The vent holes 5*f* are through-holes. On the outer surface of the female mold 5 is provided a vent hole 5*g* which leads to the hollow part 5*e*. Thus, the vent holes 5*f*, the hollow part 5*e*, and the vent hole 5*g* connect up with each other in the female mold 5 to provide interconnecting passages from the inner surface of the impression 5*a* to the outside of the female mold 5.

In the present embodiment, the extensible sheet 7 forms passages for a fluid in the thickness direction thereof to show fluid permeability similarly to the fluid-permeable material disposed on the outer surface of the papermaking mold 1. These passages let a fluid pass through without being collapsed even when the papermaking mold 1 is in the pressed state. Accordingly, the sheet 7 of the present embodiment can be of the same material as used for the fluid-permeable material.

While the pulp layer 4 is dewatered by pressing, shaped, and dried by heating in this embodiment, the water content in the pulp layer 4 is discharged out of the female mold 5 through the sheet 7 and the above-described passages (interconnecting passages made of the vent holes 5*f*, the hollow part 5*e*, and the vent hole 5*g*) with the papermaking mold 1 being pressed and deformed as shown in FIG. 4. Hot air may be supplied into the core 10 through the suction pipe 42 of the papermaking mold 1 to further accelerate the heat drying of the pulp layer 4.

In this embodiment, too, the molded article 6 can be released with ease in the same manner as in the embodiment shown in FIGS. 3(*a*) to 3(*f*).

Modifications of the papermaking mold 1 shown in FIG. 1 are described by referring to FIGS. 5 through 13. The embodiments shown in FIGS. 5 through 13 will be explained only with reference to the differences from that shown in FIGS. 1 and 2. Otherwise the description given to the embodiment of FIGS. 1 and 2 applies appropriately.

Figure 5:
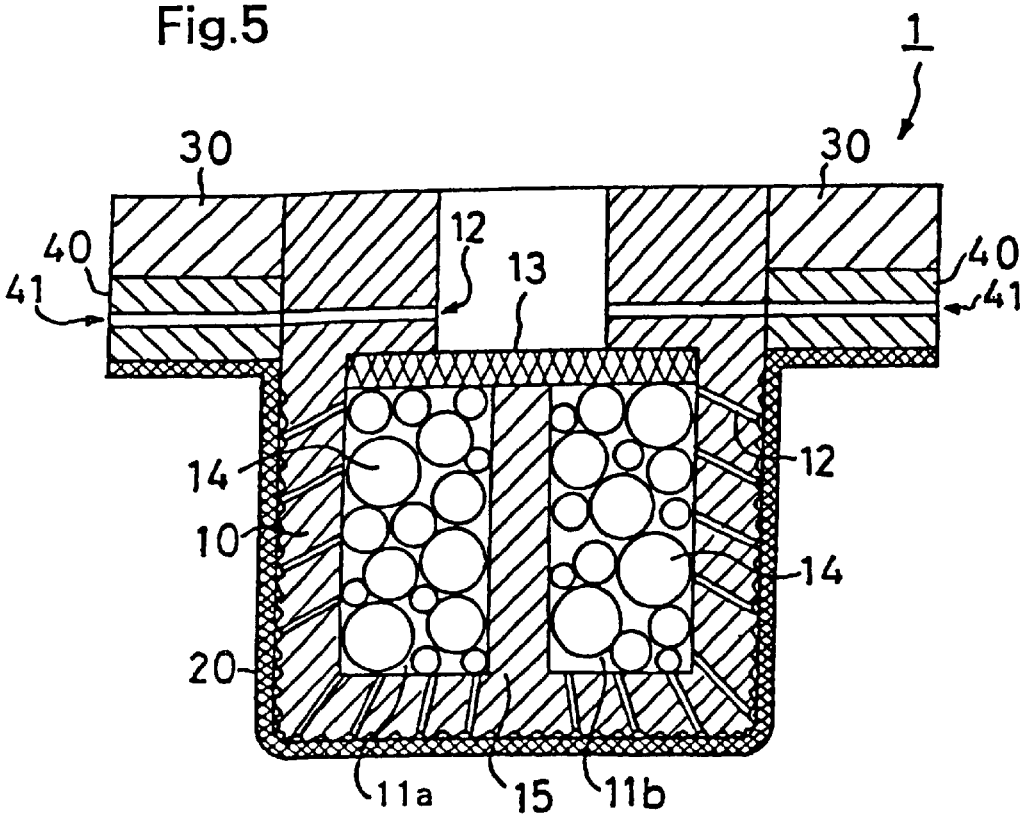
FIG. 5 is a vertical cross section of a papermaking mold, which is a modification of the papermaking mold shown in FIG. 1 (corresponding to FIG. 1).
Figure 6:
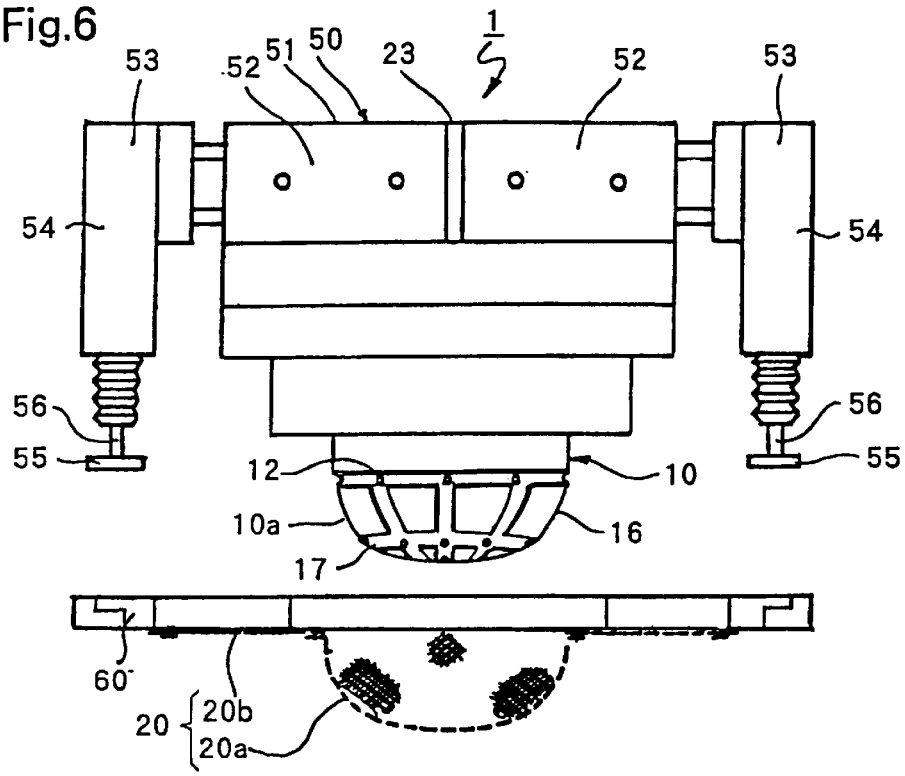
FIG. 6 is a exploded front view of another modification of the papermaking mold shown in FIG. 1.

The difference of the embodiment shown in FIG. 5 from that shown in FIGS. 1 and 2 resides in the internal structure of the core 10 in the papermaking mold 1. In detail, the inside of the core 10 is partitioned by a partition 15 into two hollow chambers 11*a* and 11*b* as illustrated in FIG. 5. A great number of fillers 14 having a prescribed shape are put into each hollow chamber 11*a* and 11*b* to fill the spaces while allowing a fluid to pass through the interstices among them. The top of the hollow chambers 11*a* and 11*b* is closed by a flexible net 13 so that the fillers 14 are prevented from getting out of the papermaking mold 1.

Similarly to the papermaking mold shown in FIG. 1, the papermaking mold used in the present embodiment has interconnecting fluid passages 12, but the length of the interconnecting fluid passages 12 in the papermaking mold used in this embodiment is shorter than that of the interconnecting fluid passages in the papermaking mold shown in FIG. 1. Therefore, when the papermaking mold 1 is pressed and deformed in the impression 5*a* of the female mold 5 (see FIG. 2), the interconnecting fluid passages 12 are less liable to collapse or closure thereby to secure more smooth progress of dewatering and drying of the pulp layer.

The fillers 14 packed into the hollow chambers 11*a* and 11*b* are preferably made of materials having a higher compressive modulus than the material making the core 10 so as to secure the fluid current among them even when the papermaking mold is pressed and deformed. In particular, aluminum, steel, copper, and the like are preferred materials of the fillers 14 from the standpoint of pressure resistance and thermal conductivity.

The fillers 14 are not particularly limited in shape, provided that they allow a fluid to flow among themselves when packed into the hollow chambers. For examples, spherical or polyhedral shapes can be used. Amorphous fillers are also usable. Hollow fillers, such as cylindrical ones, can also be used.

The papermaking mold 1 shown in FIGS. 6 through 9 has a core 10 having interconnecting fluid passages 12, a fluid-permeable material 20 which is detachably disposed on the surface 10*a* of the core 10, and a positioning and releasing means 50 which controls placement of the fluid-permeable material 20 on the surface 10*a* of the core 10 and release of the core 10 from the fluid-permeable material 20.

The core 10 is a male mold having a protrusion 16 which protrudes downward.

Figure 7:
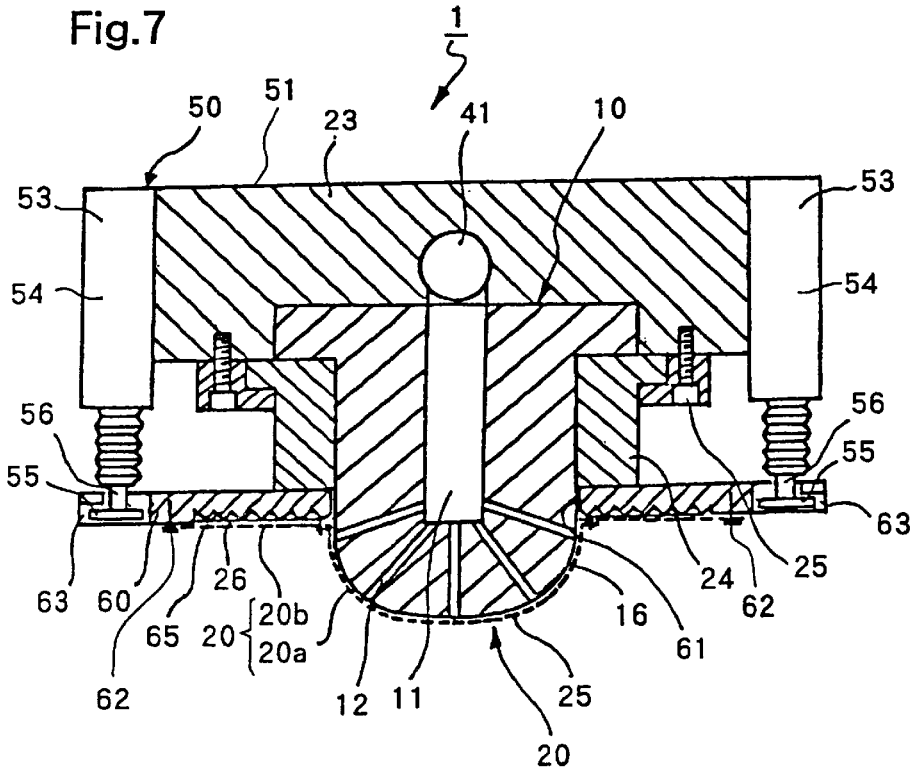
FIG. 7 is a cross-section of the main part of the papermaking mold shown in FIG. 6.

The surface 10*a* at the tip of the protrusion 16 is shaped to the inner contour of a molded article to be produced. As shown in FIG. 7, the interconnecting fluid passages 12 formed in the inside of the core 10 connect with the hollow chamber 11. Flow channels 17 are formed on the surface 10*a* of the core 10 in a checkered pattern, and the interconnecting fluid passages 12 have their ends open in these flow channels (see FIG. 6). The core 10 is fixed to the lower side of a mounting plate 23 by means of a cylindrical cushioning material 24 and a screw 25. The mounting plate 23 has a through-hole 41 which connects up with the hollow chamber 11 and a suction pump (not shown).

Figure 8:
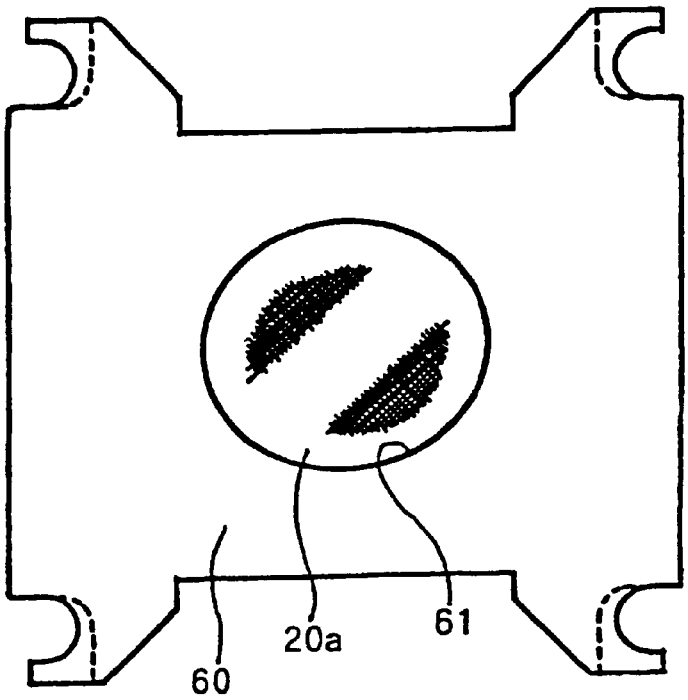
FIG. 8(*a*) is a plan view of a support plate used in the papermaking mold shown in FIG. 6, and FIG. 8(*b*) is a base view of the support plate.
Figure 8:
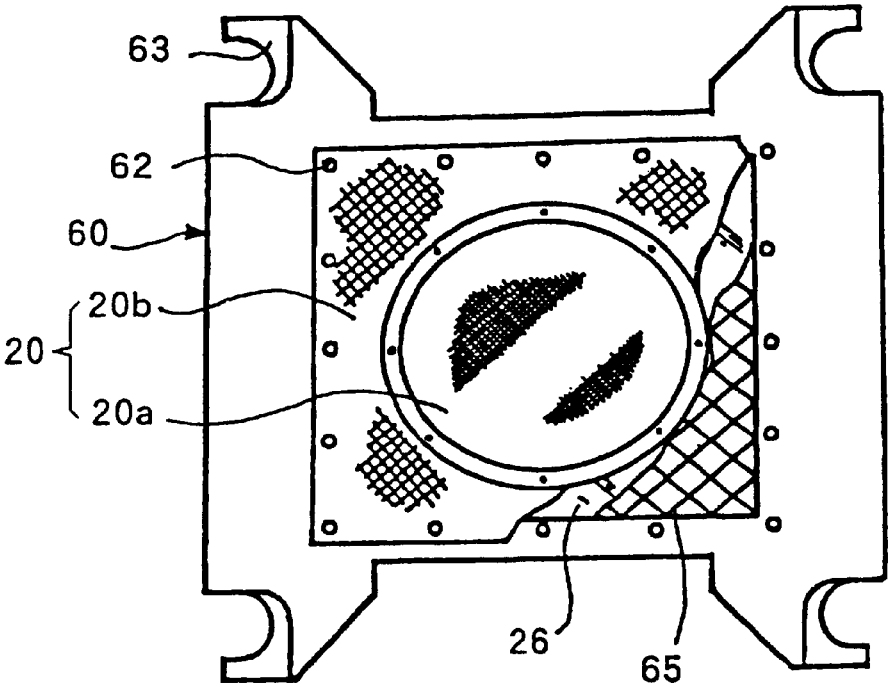

The fluid-permeable material 20 which is to be disposed on the surface 10*a* of the core 10 is fixed to the lower side of a support plate 60 with a screw 62 as shown in FIGS. 7 and 8.

The support plate 60 has an opening 61 in the center thereof, through which the protrusion 16 of the core 10 is put. On the lower side of the support plate 60 are formed flow channels 65 in a checkered pattern. At each corner of the support plate 60 is made a recess 63 with which an engaging flange 55 of a positioning and releasing means 50 hereinafter described is engaged.

The fluid-permeable material 20 is composed of an extensible and flexible net 20*a* which covers the surface 10*a* of the core 10 to provide a papermaking surface 25 and a hard net 20*b* which has stiffness.

The flexible net 20*a* includes a natural fiber net, a synthetic fiber net, and a metal fiber net, which can be used either alone or as a combination thereof. A net knitted out of a combination of these fibers is also useful. A knitted web is preferably used for its flexibility. The natural fiber includes plant fiber and animal fiber. The synthetic fiber includes fiber of synthetic resins, such as thermoplastic resins, thermosetting resins or semisynthetic resins. The metal fiber includes stainless steel fiber and copper fiber. The flexible net 20*a* is preferably subjected to fiber surface modification to improve the slip properties and the durability of the net. In order to prevent the flexible net 20*a* from coming into close contact with the suction surface thereby to improve suction efficiency, it is preferred for the flexible net 20*a* to have an average open area ratio of 15 to 80%, particularly 50 to 80%. In order to carry out papermaking securely while preventing the solid matter of the pulp slurry from passing through the net or clogging the net, it is preferred for the flexible net 20*a* to have an average maximum opening width of 0.2 to 2.5 mm, particularly 0.5 to 1.5 mm. To secure water permeability for satisfactory papermaking, the flexible net 20*a* preferably has an opening size of 20 to 70 mesh (according to JIS L0208, hereinafter the same), particularly 30 to 60 mesh.

The hard net 20*b* includes a net of metal, such as stainless steel or copper, and a net of a synthetic resin. A metal net made of stainless steel is preferably used for its durability, heat resistance and the like. To secure gaps, the opening size of the hard net is preferably 20 to 70 mesh, still preferably 30 to 60 mesh.

The hard net 20*b* has an opening in its central portion, which corresponds to the protrusion 16 of the core 10 similarly to the support plate 60. The flexible net 20*a* is fixed to the edge of this opening with fixtures. In the present embodiment a cushioning sheet 26 made of silicone rubber is provided between the flow channels 65 and the hard net 20*b* to make the pressing force even. The cushioning sheet 26 has a large number of water-penetrating holes (not shown) of 3 to 5 mm in inner diameter dispersed over the entire area thereof so as to secure water passages.

Figure 9:
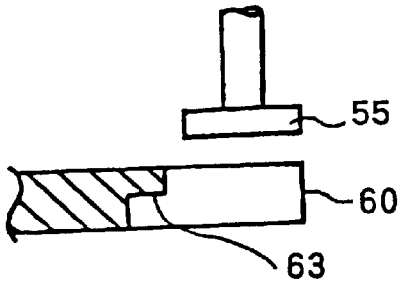
FIGS. 9(*a*) through 9(*f*) are enlarged views of a part of the support plate which is being engaged with a positioning and releasing means, in which FIG. 9(*a*) is a vertical cross section showing the state before engagement.
Figure 9:
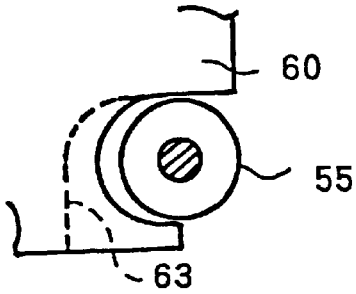
Figure 9:
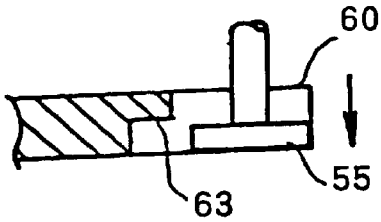
Figure 9:
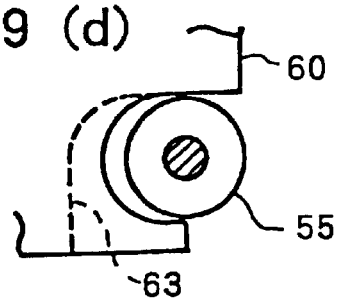
Figure 9:
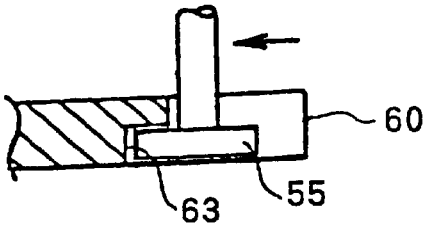
Figure 9:
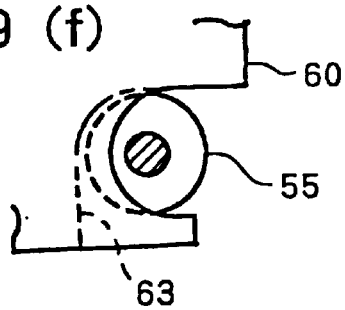

As shown in FIG. 7, the positioning and releasing means 50 is mainly composed of a handling unit 51 fixed to each side of the mounting plate 23. The handling unit 51 has a pair of well-known cylinder mechanisms 52 (right and left) and hands 53 that are moved horizontally by the respective cylinder mechanisms 52 (see FIG. 6). Each hand 53 has a piston rod 56 that is moved vertically by a well-known cylinder mechanism 54. Each piston rod 56 has, on its tip, an engaging flange 55 which is to be engaged with a recess 63 provided at the four corners of the support plate 60. Positioning of the fluid-permeable material 20 on the surface 10*a* of the core 10 and separation between the fluid-permeable material 20 and the core 10 can be carried out freely as follows. The cylinder mechanism 52 on either side is operated to dispose the engaging flange 55 at a right position in the horizontal direction as shown in FIGS. 9(*a*) and 9(*b*). The cylinder mechanism 54 on either side is operated to have the engaging flange 55 go down as shown in FIGS. 9(*c*) and 9(*d*). The cylinder mechanism 52 is again operated to move the engaging flange 55 horizontally to be engaged with the recess 63 as shown in FIGS. 9(*e*) and 9(*f*). The cylinder mechanism 54 is again operated to lift the engaging flange 55.

Figure 10:
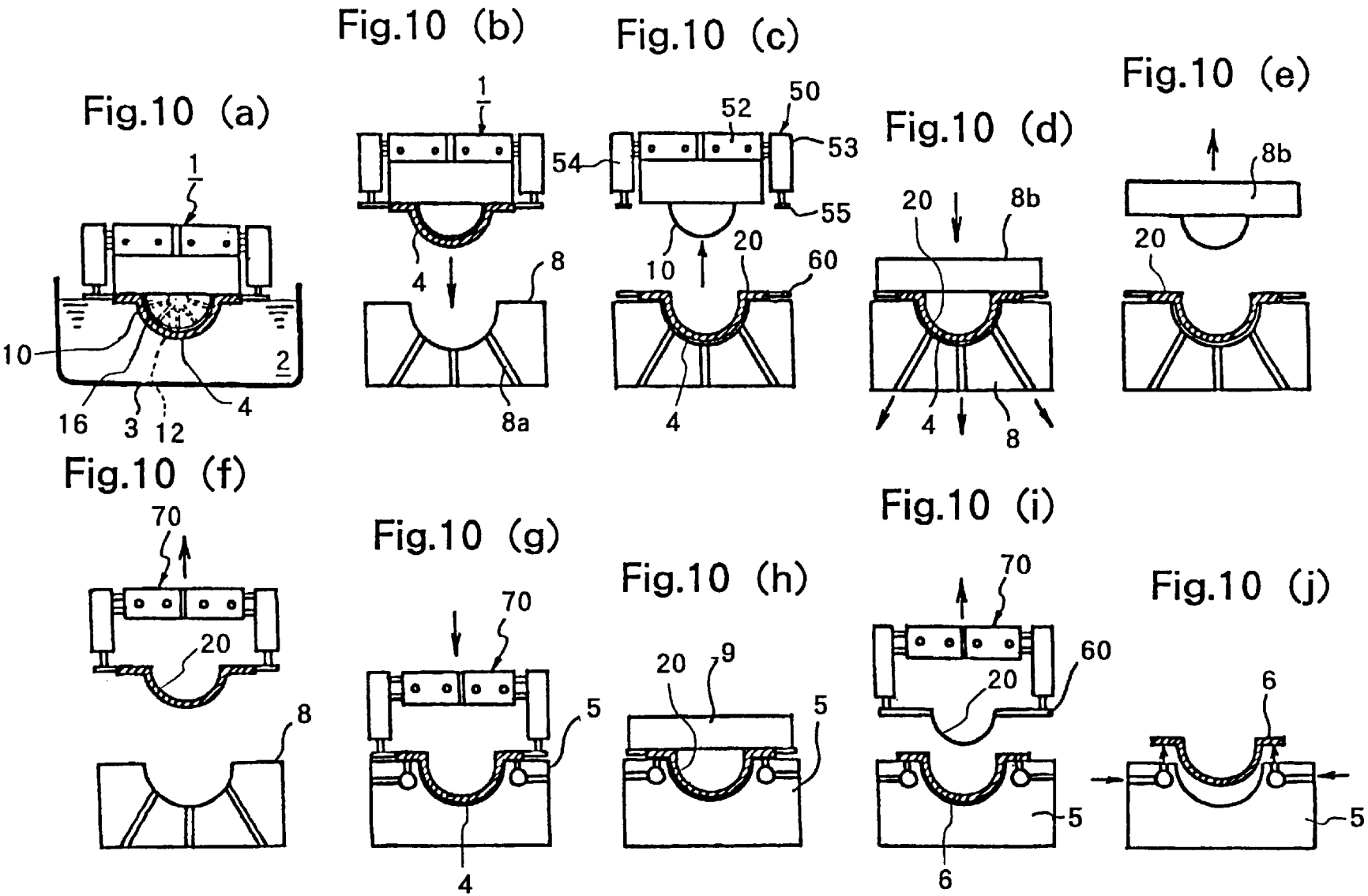
FIGS. 10(*a*) through 10(*j*) schematically depict the steps involved in a method of producing a pulp molded article by use of the papermaking mold shown in FIG. 6, in which FIG. 10(*a*) illustrates the step of papermaking.

A method of producing a pulp molded article by use of the papermaking mold 1 shown in FIGS. 6 to 9 is described by referring to FIGS. 10(*a*) to 10(*j*). The method according to the embodiment here is characterized by including a papermaking step in which a papermaking mold comprising a core having interconnecting fluid passages and a fluid-permeable material detachably disposed on the surface of the core is immersed in a pulp slurry, and the pulp slurry is sucked up through the interconnecting fluid passages to accumulate the pulp of the pulp slurry on the surface of the fluid-permeable material to form a pulp layer and a dewatering step in which the pulp layer formed in the papermaking step is transferred into a dewatering mold together with the papermaking mold, the core is released from the fluid-permeable material, and the pulp layer is pressed onto the inner surface of the dewatering mold together with the fluid-permeable material by means of a dewatering pressing means to dewater.

As shown in FIG. 10(*a*), the papermaking mold 1 is moved to above a container 3 filled with a pulp slurry 2, and its protrusion 16 is immersed in the pulp slurry 2. The pulp slurry 2 is sucked up through the interconnecting fluid passages 12, whereby the solid components in the pulp slurry 2 are deposited on the surface of the fluid-permeable material 20 to form a pulp layer 4.

Then, the pulp layer 4 formed in the papermaking step is moved into a dewatering mold 8 together with the papermaking mold 1 as shown in FIG. 10(*b*). The dewatering mold 8 has suction passages 8*a* through its body, which lead to a suction pump (not shown). Dewatering can be conducted through the suction passages 8*a*.

As shown in FIG. 10(*c*), the cylinder mechanisms 52 and 54 of the positioning and releasing means 50 are operated to disengage the engaging flanges 55 from the respective recesses 63 of the support plate 60 and to release the core 10 from the fluid-permeable material 20. As shown in FIG. 10(*d*), the pulp layer 4 is pressed toward the inner wall of the dewatering mold 8 together with the fluid-permeable material 20 by a pressing mold (a pressing means for dewatering) 8*b*. The released core 10 is combined with another fluid-permeable material (not shown) disposed on its surface 10*a* to make another papermaking mold, which is moved to carry out the same papermaking step as described above to make another molded article. The dewatering and suction time and the pressing degree by the pressing mold 8*b* are appropriately set according to the size, the shape, etc. of the molded article. While not shown, the pressing mold 8*b* has passages in its body similarly to the core 10 of the papermaking mold 1. While the pulp layer is pressed by the pressing mold 8*b*, pressurizing air is blown through these passages while sucked through the dewatering mold 8 to achieve high dewatering efficiency. After dewatering to a prescribed water content, the pressing mold 8*b* is removed from the fluid-permeable material 20 as shown in FIG. 10(*e*).

For transfer to a drying step, a handling device 70 having a handling unit 51 similar to the handling unit of the papermaking mold 1 is used to remove the dewatered pulp layer 4 from the dewatering mold 8 (FIG. 10(*f*)) and to transfer the pulp layer 4 together with the fluid-permeable material 20 into a female mold 5 for drying (FIG. 10(*g*)). As shown in FIG. 10(*h*), the pulp layer 4 is pressed and dried together with the fluid-permeable material 20 onto the inner wall of the female mold 5 by a pressing mold (pressing means for drying) 9 to obtain a molded article. The temperature of the female mold, the drying time and the like are selected appropriately according to the size, shape and material of the molded article and the like. While not shown in the drawing, the pressing mold 9 also has the same passages in its body as the interconnecting fluid passages 12 of the core 10 in the papermaking mold 1, through which steam generated on pulp layer drying is discharged to achieve high drying efficiency.

On completion of the drying, the fluid-permeable material 20 is separated from the molded article 6 by means of the handling device 70 while leaving the molded article 6 in the female mold 5 as shown in FIG. 10(*i*). Air is blown off from the female mold 5 onto the dried molded article 6 to remove the molded article 6 from the female mold as shown in FIG. 10(*j*).

In the pulp molded article production method according to the present embodiment, since the pulp layer 4 can be transferred to the drying mold 8 together with the fluid-permeable material 20 after completion of the papermaking step, there is no need to directly handle the wet pulp layer 4 susceptible to deformation. As a result, the wet pulp layer can be transferred from the papermaking step to the dewatering step smoothly to manufacture a molded article with high precision.

Since the core 10 is separated from the fluid-permeable material 20 after completion of the papermaking step, another fluid-permeable material can be disposed on the separated core 10 to make another papermaking mold, which can be used for a next pulp molding cycle. This leads to a further increased production efficiency.

Figure 11:
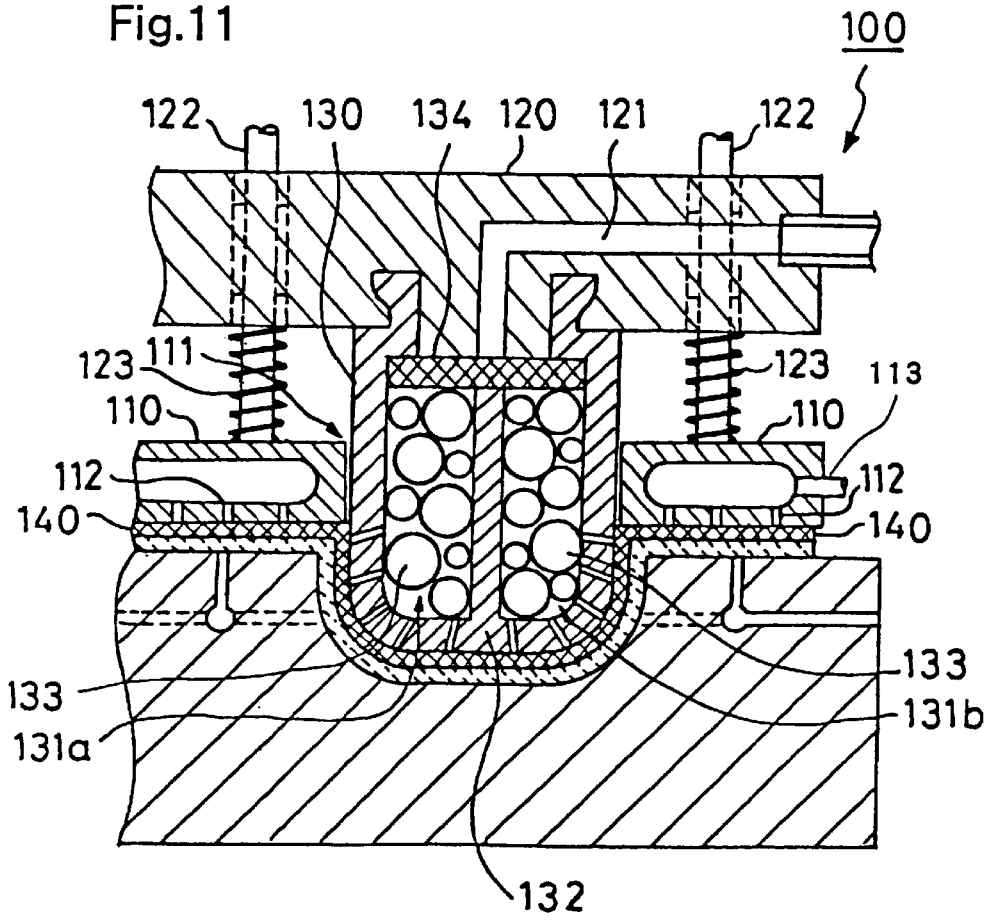
FIG. 11 is a vertical cross-section of a papermaking mold, which is another modification of the papermaking mold shown in FIG. 1.
Figure 12:
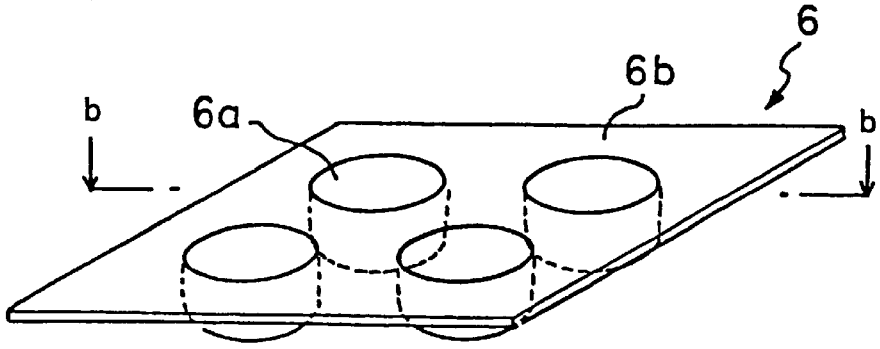
FIG. 12(*a*) is a perspective view of a molded article produced by use of the papermaking mold shown in FIG. 11, and FIG. 12(*b*) is a cross-sectional view of FIG. 12(*a*) along line b—b.
Figure 12:
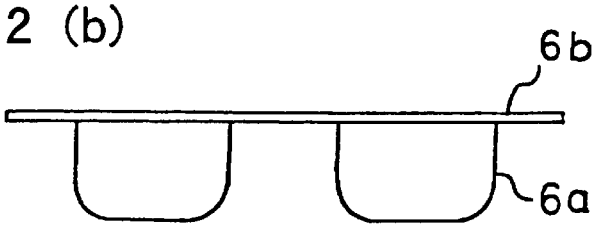

A papermaking mold 100 according to an embodiment shown in FIG. 11 is used to produce a molded article 6 shown in FIGS. 12(*a*) and 12(*b*), which comprises a plurality of flanged hollow containers 6*a* connected to each other via flanges 6*b* extending outward from the periphery of the opening of each hollow container 6*a*. In this embodiment, a four-container molded article 6 is produced, which provides four hollow containers 6*a* at a time. FIG. 11 illustrates a cross-section of the main part of the papermaking mold 100 according to the present embodiment, showing the part for making one of the four hollow containers 6*a*.

The papermaking mold 100 used in the present embodiment has a flat papermaking plate 110 having a plurality of through-holes 111 at a prescribed interval, an upper plate 120 disposed above the papermaking plate 110, a number of cores 130 each fixed to the lower side of the upper plate 120 and fitted into each through-hole 111 of the papermaking plate 110 from the upper side of the papermaking plate 110, and a fluid-permeable material 140 covering the lower side of the papermaking plate 110.

The papermaking plate 110 is constituted of a rigid body that is hollow inside. The papermaking plate 110 is flat on its lower side and has a large number of holes for fluid passage 112 which are open on the lower side and lead to the inside cavity. The papermaking plate 110 also has an interconnecting passage 113 which interconnects the cavity and the outside. The interconnecting passage 113 is connected to a suction means such as a vacuum pump (not shown).

The fluid-permeable material 140 which covers the lower side of the papermaking plate 110 is the same as the one used in the papermaking mold 1 shown in FIG. 1. Therefore, the fluid-permeable material 140 is capable of forming passages for a fluid in its thickness direction even when it is pressed and deformed. In addition, the fluid-permeable material 140 has such extensibility as to be extended sufficiently when the core 130 is fitted through the through-hole 111.

The core 130 has almost the same structure as the core of the papermaking mold shown in FIG. 5. That is, the cavity of the core 130 is partitioned by a partition 132 into two hollow chambers, 131*a* and 131*b*, each hollow chamber being filled with a great number of fillers 133. The top of the hollow chambers 131*a* and 131*b* is closed by a flexible net 134.

The upper part of the core 130 is engagedly fixed to the lower side of the upper plate 120. The upper plate 120 has formed therein a passage 121 which interconnects the outer side of the upper plate 120 and the inside of the core 130 as engaged with the upper plate 120. The interconnecting passage 121 is connected to a suction means such as a vacuum pump (not shown) similarly to the passage 113 formed through the papermaking plate 110.

The upper plate 120 is connected to the papermaking plate 110 via a number of connecting guides 122 (FIG. 11 shows two of them) in such a manner as to slide vertically. Each connecting guide 122 connects the upper plate 120 and the papermaking plate 110 with a coil spring 123 fitted therearound. As the upper plate 120 slides down, the core 130 fixed to the lower side of the upper plate 120 is detachably fitted into the through-hole 111 of the papermaking plate 110.

Figure 13:
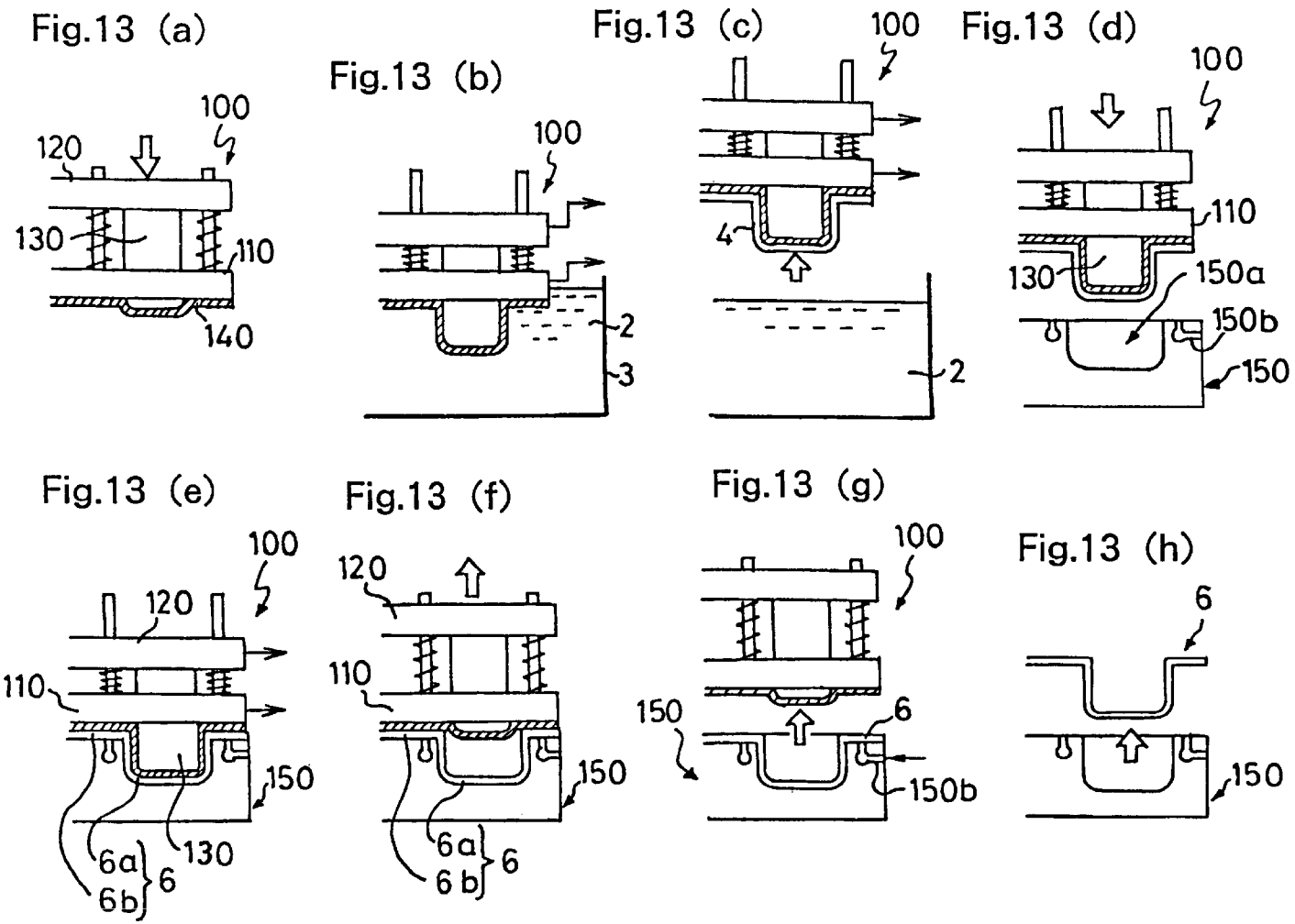
FIGS. 13(*a*) through 13(*h*) schematically illustrate the steps involved in a method of producing a pulp molded article by use of the papermaking mold shown in FIG. 11, in which FIG. 13(*a*) shows the step of inserting a core.

A pulp molded article production method using the papermaking mold 100 shown in FIG. 11 is described by referring to FIGS. 13(*a*) through 13(*h*). FIG. 13(*a*) shows the step of inserting a core; FIG. 13(*b*), the step of papermaking; FIG. 13(*c*), the step of pulling up the papermaking mold; FIG. 13(*d*), the step of fitting into a female mold; FIG. 13(*e*), the step of pressing the papermaking mold; FIG. 13(*f*), the step of removing the core; FIG. 13(*g*), the step of removing the papermaking mold; and FIG. 13(*h*), the step of removing a molded article.

First of all, the upper plate 120 is slid down to fit the cores 130 into the respective through-holes of the papermaking plate 110 and to have the cores 130 project below the lower side of the papermaking plate 110 as shown in FIG. 13(*a*). As the cores 130 project, the fluid-permeable material 140 extends to cover the outer surface of the projecting cores 130.

The upper plate 120 is pressed down to the lowest position to have the cores 130 project to a prescribed depth. The depth of projection is set larger than the depth of impressions 150*a* of a female mold 150 described later. The papermaking mold 100 is then placed in a container 3 filled with a pulp slurry 2 as illustrated in FIG. 13(*b*). In this state, the cores 130 and the papermaking plate 110 are evacuated by suction from the outside toward the inside through the passages 121 (see FIG. 11) in the upper plate 120 and the passages 113 (see FIG. 11) in the papermaking plate 110 to form a water-containing pulp layer on the surface of the fluid-permeable material 140.

After a pulp layer having a prescribed thickness is formed, the papermaking mold 100 is pulled out of the pulp slurry 2, and the suction is continued until the pulp layer 4 is dewatered to a prescribed water content as shown in FIG. 13(*c*).

As shown in FIG. 13(*d*), the projecting cores 130 of the papermaking mold 1 having the pulp layer 4 formed thereon are then fitted into the respective impressions 150*a* of a multi-impression female mold 150 in such a manner that each base of the pulp layer 4 formed on the outer surface of the core 130 is the first to come into contact with the bottom of each impression 150*a*. The impressions 150*a* are arranged in the same configuration as the cores 130. The female mold 150 has been heated to a prescribed temperature beforehand. The inner surface of the impressions 150*a* of the female mold 150 is smooth with no vent holes for discharging water or steam. Vent holes 150*b* are provided on the surface of the female mold 150 facing the papermaking plate 110, i.e., on the surface where a molded article is to be formed.

The papermaking mold 100 is then pressed under a prescribed pressure as shown in FIG. 13(*e*), whereby the cores 130 of the papermaking mold 100 are pressed and deformed to the shape of the impressions 150*a* of the female mold 150 to completely fill the space in the impressions 150*a*. As a result, the pulp layer 4 formed on the outer surface of the cores 130 is further pressed and dewatered, and, at the same time, the inner configuration of the impressions 150*a* is transferred onto the pulp layer 4 thereby to form hollow containers 6*a* of a molded article 6. The pulp layer 4 formed on the lower side of the papermaking plate 110 of the papermaking mold 100 is squeezed between that side and the upper side of the female mold 150 to form the flange 6*b* in the resulting molded article 6.

While keeping the papermaking mold 100 in the pressed state, the cores 130 and the papermaking plate 110 are evacuated by suction from the outside toward the inside through the passages 121 (see FIG. 11) in the upper plate 120 and the passages 113 (see FIG. 11) in the papermaking plate 110, whereby the water content (water and steam) contained in the pulp layer 4 is discharged out of the papermaking mold 100 through the fluid-permeable material 140.

The papermaking mold 100 is maintained in the pressed state for a prescribed period of time to dry the pulp layer 4 to give a desired pulp molded article 6. As shown in FIG. 13(*f*), the upper plate 120 is lifted while leaving the papermaking plate 110 in contact with the female mold 150 to pull the cores 130 from the respective through-holes of the papermaking plate 110. As the cores 130 are pulled up, the fluid-permeable material 140 covering the outer surface of the cores 130 shrinks. It follows that the hollow containers 6*a* of the molded article 6 separate from the surface of the fluid-permeable material 140.

As shown in FIG. 13(*g*), the whole papermaking mold 100 is pulled up to release the whole molded article 6 from the surface of the fluid-permeable material 140. Air is blown off from the female mold 150 onto the molded article 6 through blow-off ports 150*b*. Gaps are thus formed between the outer side of the female mold 150 and the outer surface of the molded article 6, whereby the molded article 6 separates from the female mold 150. Finally, the molded article 6 is removed from the female mold 150 as shown in FIG. 13(*h*).

In this embodiment, too, the resulting pulp molded article 6 has a smooth surface and an extremely satisfactory appearance similarly to each of the aforementioned embodiments. Further, the flange 6*b* in the molded article 6 has a satisfactory finish. Furthermore, the molded article 6 can be released from the female mold 150 extremely smoothly.

Figure 14:
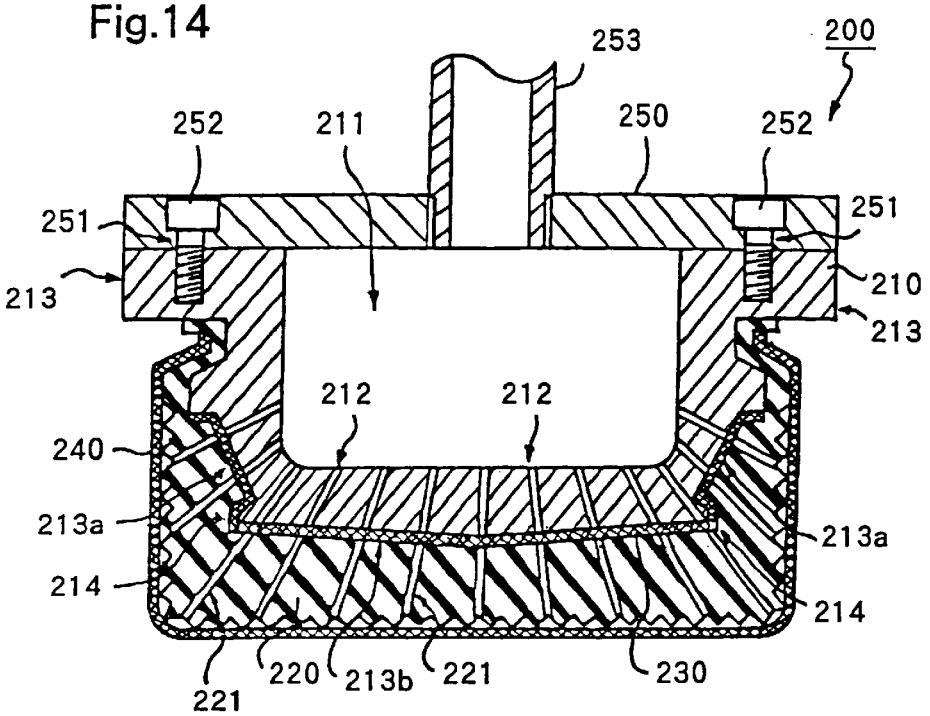
FIG. 14 is a vertical cross section of a papermaking mold, which is still another modification of the papermaking mold shown in FIG. 1.

Other modified papermaking molds according to the present invention will be explained by referring to FIGS. 14 through 22. A papermaking mold 200 according to the embodiment shown in FIG. 14 is for production of a molded article of box shape with an open top. The papermaking mold 200 has a core 210, a core holding member 220 which is positioned under the core 210, a water- and air-permeable member 230 which is interposed between the core 210 and the core holding member 220, a mesh member 240 which covers the outer surface of the core holding member 220, and a cap plate 250 which closes the top of the core 210.

The core 210 is a rigid body formed of metals, plastics or like materials. The core 210 is hollow with an open top to form a chamber 211. A plurality of fluid passage holes 212 are formed on the inner side of the chamber 211, with which the chamber 211 and the outside of the core 210 are interconnected. The fluid passage holes 212 radiate out from the chamber 211 toward the outside of the core 210. The peripheral edges of the chamber 211 extend outward to form a flange 213.

The core 210 has, on its side in contact with the core holding member 220 (described later), a tapered side section 213*a* having the shape of a truncated inverted pyramid and a tapered base section 213*b* having the shape of a pyramid with a gentle slope. The peripheral edges of the tapered base section 213*b*, i.e. the edges between the tapered side section 213*a* and the tapered base section 213*b* overhang to form overhangs 214. The overhangs function as engaging parts fitting the core holding member 220 described later.

The core holding member 220 has a contour slightly smaller than that of a molded article to be made and is disposed beneath the core 210. The core holding member 220 has a depression on the upper side to form a space of prescribed shape. The space is shaped to have engaging parts in which the overhangs 214 of the core 210 are fitted to fix the core holding member 220 to the core 210. The space is so shaped to contain the tapered side section 213*a*, the pyramidal tapered base section 213*b*, and the overhangs 214 of the core 210. All the sides and the base of the core holding member 220, which are outer surfaces of the core holding member 220, have an uneven mesh pattern.

The core holding member 220 is made of an elastically deformable material. Examples of such a material include rubbery materials, e.g., silicone rubber, flexible rubber, and urethane rubber.

As shown in FIG. 14, the core holding member 220 has formed therein interconnecting holes 221 which link up with the fluid passage holes 212 formed in the core 210 when the core holding member 210 is disposed under the core 210 and engaged with the core 210. The interconnecting holes 221 radiate out toward the outer surface of the core holding member 220. The number of the interconnecting holes 221 is preferably 1 to 4, particularly 1 to 2, per $cm^2$ of the outer surface of the core holding member 220, for securing dewatering efficiency and for securing sufficient strength of the core holding member 220 while the core holding member 220 is elastically deformed to press a pulp layer 4.

The water- and air-permeable member 230 interposed between the core 210 and the core holding member 220 serves for smooth interconnection between the fluid passage holes 212 of the core 210 and the interconnecting holes 221 of the core holding member 220 when the core 210 and the core holding member 220 are fitted together. It is made of, for example, a metal mesh or open weave fabric.

The mesh member 240 covers all the sides and the base constituting the outer surface of the core holding member 220 in close contact along the contour. Since the outer surface of the core holding member 220 has an uneven mesh pattern as previously stated, a prescribed space is left between the mesh member 240 and the outer surface of the core holding member 220 even with the mesh member 240 intimately covering the outer surface of the core holding member 220. The mesh member 240 is made of an extensible and contractible material. Such a material includes natural materials such as plant fiber and animal fiber, regenerated resins, semi-synthetic resins, synthetic resins such as thermoplastic resins and thermosetting resins, and metals. The mesh member 240 may be made of the above-described fluid-permeable material. The mesh member 240 may have either a single layer structure or a double layer structure. Where the mesh member 240 has a single layer structure, it is preferable from the standpoint of water absorption, air permeability and strength that the mesh member 240 have an average open area ratio of 10 to 80%, particularly 20 to 40% in the state intimately covering the outer surface of the core holding member 230.

Where the mesh member 240 has a double layer structure, it is preferred that the mesh member 240 be composed of a first net layer and a second net layer which is finer than the first net layer. It is preferred that the first net layer be tightly put on the core holding member 220 and that the second net layer be put on the first net layer. It is also preferred that the first net layer be tightly put on the outer surface of the core holding member 220 with the second net layer being integrally formed on the first net layer. By using the double-layered mesh member 240, the number of the interconnecting holes to be bored in the core holding member 220 can be decreased, and a pulp layer (described later) can be formed on the mesh member 240 with a uniform thickness. In this case, the first net layer preferably has an average open area ratio of 10 to 99%, particularly 40 to 60%, in the state intimately covering the outer surface of the core holding member 220, and the second net layer preferably has an average open area ratio of 10 to 80%, particularly 20 to 40%, in the same state.

The cap plate 250 is rectangle and has the same contour as the flange 213 formed on the upper part of the core 210 in its plan view. Through-holes 251 are bored in the peripheral portion of the cap plate 250. Threaded holes are drilled in the flange 213 of the core 210 at positions mating with the through-holes 251. In the assembly of the papermaking mold 200, a screw 252 is put in each through-hole 251 of the cap plate 250 and screwed in through each hole of the flange 213 of the core 210 thereby to fix the cap plate 250 to the core 210.

The cap plate 250 has a threaded through-hole in approximately the center thereof, through which a suction pipe 253 is screwed in. Thus, in the papermaking mold 200 as assembled, the suction pipe 253, the chamber 211, the fluid passage holes 212, the water- and air-permeable member 230, and the interconnecting holes 221 are interconnected to form interconnecting passages which connect the outside and the inside of the papermaking mold 200.

Figure 15:
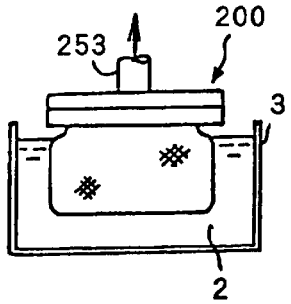
FIGS. 15(*a*) to 15(*f*) schematically illustrate the steps involved in a method of producing a pulp molded article by use of the papermaking mold shown in FIG. 14, wherein FIG. 15(*a*) is the step of papermaking.
Figure 15:
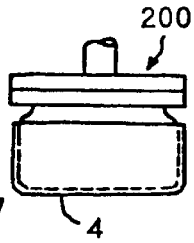
Figure 15:
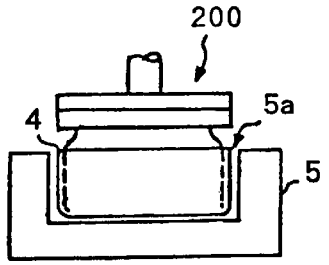
Figure 15:
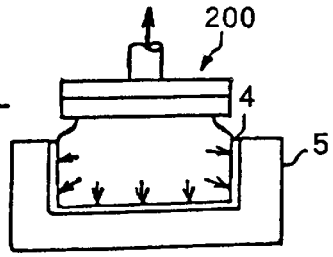
Figure 15:
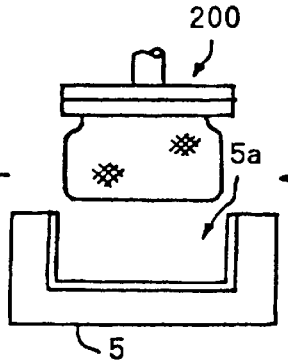
Figure 15:
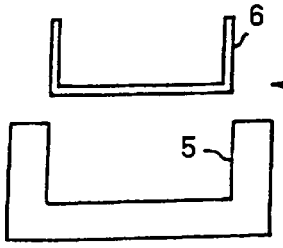

A pulp molded article production method by use of the papermaking mold 200 shown in FIG. 14 will be described. FIGS. 15(*a*) to 15(*f*) schematically illustrate the steps involved in the method of producing a pulp molded article by use of the papermaking mold shown in FIG. 14. Specifically, FIG. 15(*a*) is the step of papermaking; FIG. 15(*b*), the step of pulling up the papermaking mold, FIG. 15(*c*), the step of fitting the papermaking mold into a female mold; FIG. 15(*d*), the step of pressing the papermaking mold; FIG. 15(*e*), the step of removing the papermaking mold; and FIG. 15(*f*), the step of removing a molded article.

As shown in FIG. 15(*a*), the papermaking mold 200 is put in a container 3 filled with a pulp slurry 2 to be immersed in the pulp slurry 2. In this state, the papermaking mold 200 is sucked through the above-mentioned interconnecting passages from the outside toward the inside by a suction means such as a pump (not shown) connected to the suction pipe 253. The water content of the pulp slurry 2 is thus sucked up through the interconnecting passages thereby to accumulate pulp fibers on the surface of the papermaking mold 200, i.e., the surface of the mesh member 240 to form a water-containing pulp layer 4. As described above, since there is a prescribed space between the outer surface of the core holding member 220 and the mesh member 240, the pulp fiber can be accumulated smoothly to form a pulp layer 4 having a uniform thickness. Where the mesh member 240 has a double layered structure composed of the first net layer and the second net layer as described above, the formed pulp layer 4 becomes more uniform because the pulp fibers are prevented more effectively from getting entangled in the mesh member 240 and making suction uneven in places. It is desirable for the core holding member 220, which is made of an elastically deformable material as stated previously, to have such stiffness so as not to be deformed by the suction.

After a pulp layer having a prescribed thickness is formed, the papermaking mold 200 is pulled out of the pulp slurry 2, and the suction is continued until the pulp layer 4 is dewatered to a prescribed water content as shown in FIG. 15(*b*).

On suction-dewatering the pulp layer 4 to a prescribed water content, the papermaking mold 200 having the pulp layer 4 formed thereon is fitted into an open impression 5*a* of a female mold 5 as shown in FIG. 15(*c*), the impression 5*a* corresponding to the outer contour of a molded article to be produced, where the pulp layer 4 is dewatered by pressing, shaped, and dried by heating.

The pulp layer 4 is fitted in such a manner that its base is the first to come into contact with the bottom of the impression 5*a* of the female mold 5. Then, the papermaking mold 200 is pressed under a prescribed pressure with a prescribed means as shown in FIG. 15(*d*). By this pressing, the core holding member 220 of the papermaking mold 200 is pressed, deformed and expanded along the inner configuration of the impression 5*a* of the female mold 5 to completely fill the space in the impression 5*a*. As a result, the pulp layer 4 formed on the surface of the papermaking mold 200 is further pressed and dewatered and, at the same time, the inner configuration of the impression 5*a* is transferred onto the pulp layer 4. In this case, since the core 210 of the papermaking mold 200 has the tapered side section 213*a* and the tapered base section 213*b* as described above, the pressing force of the papermaking mold 200 is transmitted uniformly throughout, and to every corner of, the core holding member 220. As a result, the inner configuration of the impression 5*a* can be transferred to the pulp layer 4 with higher precision.

The papermaking mold 200 is kept in the pressed state for a prescribed time while sucking steam through the suction pipe 253 until the pulp layer 4 dries to provide a desired pulp molded article. The pressing of the papermaking mold 200 is then stopped, whereby the core holding member of the papermaking mold 200 returns to its original configuration before being pressed, while the resulting pulp molded article separates from the surface of the papermaking mold 200 and stays in the impression 5*a* of the female mold 5. The papermaking mold 200 is taken out from the impression 5*a* as shown in FIG. 15(*e*), and the pulp molded article 6 is removed from the impression 5*a* as shown in FIG. 15(*f*).

According to this embodiment, papermaking, dewatering and shaping can be accomplished on a single papermaking mold, which simplifies the production process. By selecting an appropriate female mold in conformity to the shape of a molded article to be produced, a molded article having a complicated shape, for example, with an undercut can be manufactured easily.

Modifications of the papermaking mold 200 shown in FIG. 14 are described by referring to FIGS. 16 to 19. The embodiments shown in FIGS. 16 through 19 will be explained only with reference to the differences from the embodiment shown in FIG. 14. The description given to the embodiment shown in FIG. 14 applies appropriately to the same particulars.

The papermaking mold shown in FIGS. 16 through 19 is characterized by comprising:

- a main body made of an elastically deformable material which has inside a cavity of prescribed shape and a plurality of holes for fluid passage that lead the cavity to the outside, and a flange extending laterally from the upper part thereof,
- an expanding and contracting member having a push part which slides in the cavity in the height direction of the main body and a push plate made of a rigid material which is connected to one end of the push part and is substantially equal to or larger than the contour of the flange in their plan view, and
- a mesh member intimately covering the outer surface of the main body,
- in which the height of the main body from its base to the lower side of the flange is slightly larger than the height of a pulp molded article to be produced,
- the push plate of the expanding and contracting member and the flange of the main body are connected by connecting guides so that the expanding and contracting member may be slid freely in the height direction of the main body,
- the expanding and contracting member has interconnecting holes which interconnect the inside and the outside thereof, and
- when the expanding and contracting member is slid down, the flange is pressed by the push plate, and the cavity is pushed wider by the push part to expand the main body through elastic deformation, and the interconnecting holes and the fluid passage holes connect with each other in at least the state before the sliding.

Figure 16:
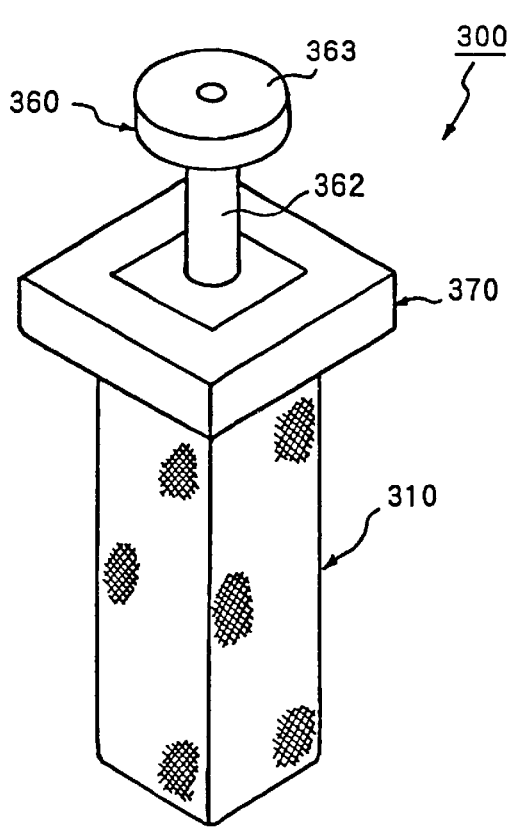
FIG. 16(*a*) is a perspective of a modification of the papermaking mold shown in FIG. 14, and FIG. 16(*b*) is a cross-section of the papermaking mold shown in FIG. 16(*a*).
Figure 16:
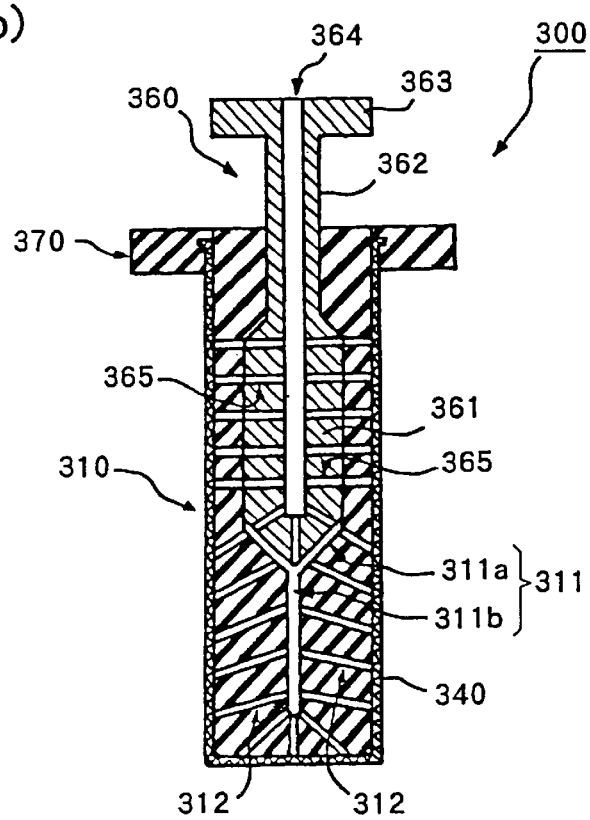
Figure 17:
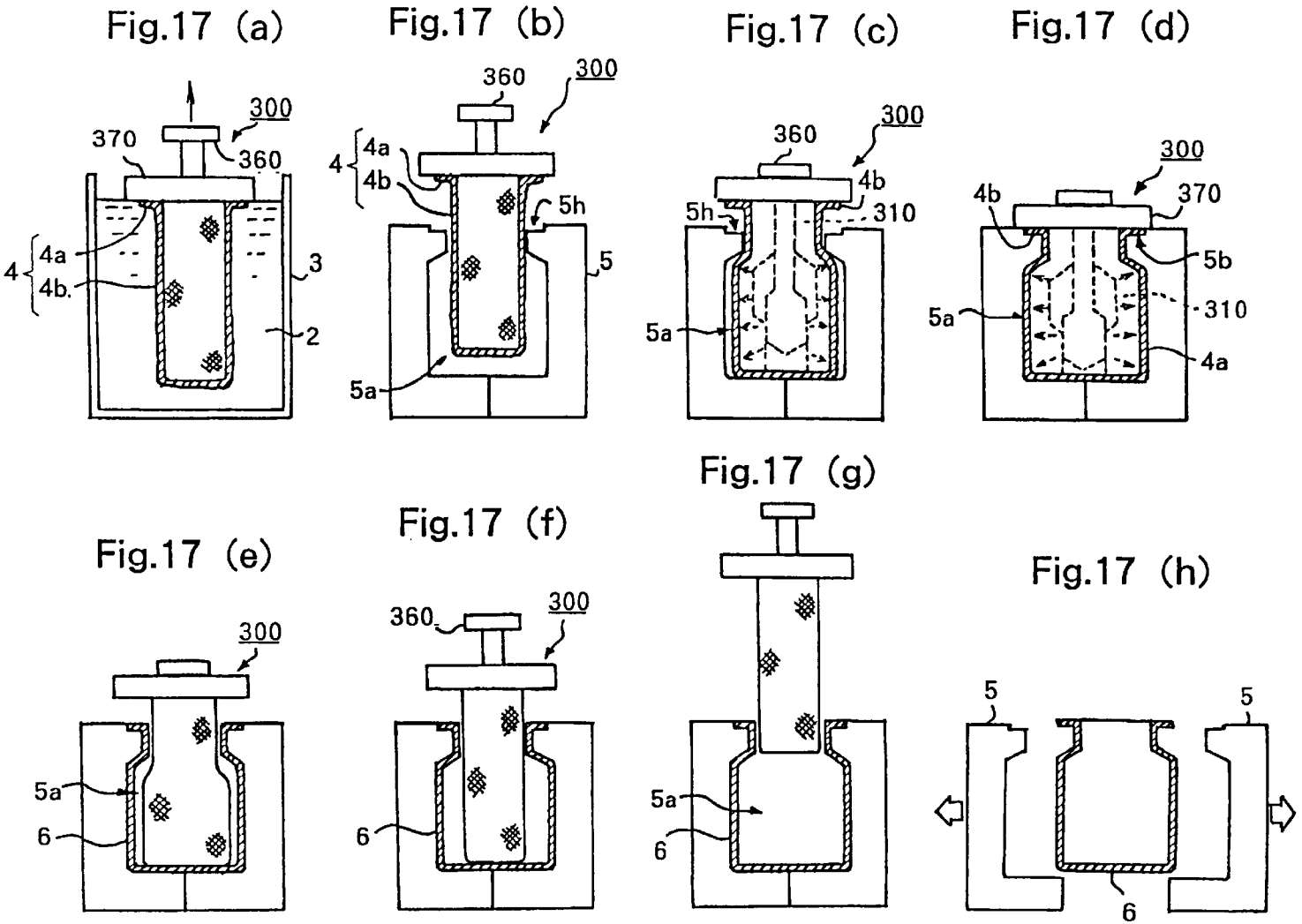
FIGS. 17(*a*) to 17(*h*) schematically show the steps involved in a method of producing a pulp molded article by use of the papermaking mold shown in FIGS. 16(*a*) and 16(*b*), wherein FIG. 17(*a*) is the step of papermaking.

The papermaking mold according to the embodiment shown in FIGS. 16 and 17 is used for production of a molded article having the shape of a box whose transverse cross-section at the opening is smaller than that at the body (a so-called overhanging shape) and which has an undercut around its opening. FIGS. 16(*a*) and 16(*b*) show a perspective view and a vertical cross-sectional view, respectively, of the papermaking mold 300 used in this embodiment. The papermaking mold 300 used in the present embodiment comprises a main body 310 made of an elastically deformable material and having inside a cavity 311 of prescribed shape which is interconnected with the outside through a plurality of fluid passage holes 312, an expanding and contracting member 360 which slides within the cavity 311 in the height direction of the main body 310, and a mesh member 340 which covers the outer surface of the main body 310 in intimate contact.

In more detail, the main body 310 in the present embodiment is a vertically oblong rectangular parallelepiped having in the inside thereof a cavity 311 formed of a first cavity 311*a* and a second cavity 311*b*. The main body 310 has a plurality of fluid passage holes 312 radiating out from the cavity 311 toward the surface of the main body 310, with which the inside and the outside of the main body 310 are interconnected. All the sides and the base which constitute the outer surface of the main body 310 has an uneven mesh pattern.

Of the cavity 311 formed in the main body 310, the first cavity 311*a* has the same shape as the contour of the whole push part 361 of the expanding and contracting member 360 (described later) and part of a handle 362 linked to the push part 361. The second cavity 311*b*, on the other hand, is a narrow hole extending along the height direction of the main body 310. The capacity of the second cavity 311*b* is far smaller than the volume of the push part 361 of the expanding and contracting member 360 described below.

The expanding and contracting member 360 has a cylindrical push part 361 with a conical tip and a cylindrical handle 362 connected at one end to the push part 361 with the other end exposed out of the main body 310. The cross-sectional diameter of the handle 362 is smaller than that of the push part 361. A disk-shaped knob 363 is provided at the end of the handle 362.

The expanding and contracting member 360 has interconnecting holes with which the inside and the outside are interconnected. The interconnecting holes are composed of a vertical pit 364 drilled from the end of the handle 362 through the handle 362 and the put part 361 and tunnels 365 from the surface of the push part 361 to the pit 364. The pit 364 and the tunnels 365 thus form interconnecting holes from the end of the handle 362 through the inside of the handle 362 to the surface of the push part 361. On use of the papermaking mold 300, the end of the handle 362 is connected to a prescribed suction means.

The upper edge of the main body 310 extends laterally to form a flange 370 as an integral part of the main body 310. The flange 370 is rectangular in its plan view and made of the same elastically deformable material as for the main body 310.

The mesh member 340 is the same as used in the papermaking mold 200 shown in FIG. 14.

In the papermaking mold 300, the expanding and contracting member 360 is slid in the height direction of the main body 310 to push the second cavity 311*b* of the cavity 311 wider. As a result, the main body 310 is expanded to a prescribed shape by elastic deformation. The interconnecting holes formed in the expanding and contracting member 360, which are composed of the pit 364 and the tunnels 365, and the fluid passage holes 312 formed in the main body 310 are designed to be interconnected with each other before and also after the sliding. FIGS. 16(*a*) and 16(*b*) depict the state before the sliding (pushing) the expanding and contracting member 360, in which the interconnection among the pit 364, the tunnels 365, and the fluid passage holes 312 can be seen. In the state after the sliding of the expanding and contracting member 360, i.e., with the expanding and contracting member 360 pushed down, the pit 364, the tunnels 365, and the fluid passage holes 312 are similarly interconnected while not illustrated.

A pulp molded article production method according to an embodiment using the papermaking mold 300 shown in FIG. 16 is described below. FIGS. 17(*a*) through 17(*h*) schematically show the steps involved in the pulp molded article production method according to this embodiment. Specifically, FIG. 17(*a*) is the step of papermaking; FIG. 17(*b*), the step of fitting the papermaking mold into a female mold; FIG. 17(*c*), the step of pushing the expanding and contracting member; FIG. 17(*d*), the step of pressing the papermaking mold; FIG. 17(*e*), the step of releasing the pressing the papermaking mold; FIG. 17(*f*), the step of withdrawing the expanding and contracting member; FIG. 17(*g*), the step of removing the papermaking mold; and FIG. 15(*h*), the step of removing a molded article.

As shown in FIG. 17(*a*), the papermaking mold 300 is immersed in a pulp slurry 2 filling a container 3 and evacuated by suction from the outside to the inside by a suction means such as a pump (not shown) connected to the expanding and contracting member 360. As a result, a pulp layer 4 is formed on the surface of the papermaking mold 300, the pulp layer 4 being composed of a pulp layer 4*a* formed on the surface of the mesh member 340 and a pulp layer 4*b* formed on the lower side of the flange 370. It is desirable for the main body 310, which is made of an elastically deformable material as stated previously, to have such stiffness so as not to be deformed by the suction.

After a pulp layer 4 having a prescribed thickness is formed, the papermaking mold 300 is pulled out of the pulp slurry 2, and the suction is continued until the pulp layer 4 is dewatered to a prescribed water content. After the pulp layer 4 is dewatered by suction to a prescribed water content, the papermaking mold 300 having the pulp layer 4 formed thereon is fitted into an open impression 5*a* of a female mold 5 as shown in FIG. 17(*b*). The opening of the impression 5*a* is wider than the transverse cross-section of the papermaking mold 300. The female mold is made up of two splits, butted together to form the impression 5*a*. Prior to the fitting of the papermaking mold 300, the female mold 5 has been heated to a prescribed temperature by a prescribed heating means. The pulp layer 4 is fitted in such a manner that its base is the first to come into contact with the bottom of the impression 5*a* of the female mold 5.

As shown in FIG. 17(*c*), the expanding and contracting member 360 is pushed down and slid from the first cavity 311*a* to the second cavity 311*b* (see FIG. 16(*b*)), whereby the second cavity 311*b* is pushed wider, and the main body 310 is expanded through elastic deformation to fill the space in the impression 5*a*. The papermaking mold 300 is further pressed into the impression 5*a* by a prescribed means, whereby the main body 310 is further deformed elastically in conformity to the shape of the impression 5*a* finally to completely fill the impression 5*a* as shown in FIG. 17(*d*). As a result, the pulp layer 4*a* is dewatered by pressing, and the inner configuration of the impression 5*a* is transferred onto the pulp layer 4*a*. During this pressing, the pulp layer 4*b* formed on the lower side of the flange 370 is pressed in a depression 5*h* made on the upper side of the female mold 5 around the opening of the impression 5*a*. Since the flange 370 is made of an elastically deformable material as stated above, the pulp layer 4*b* is pressed onto the depression 5*h* with an extreme good contact.

The papermaking mold 300 is kept in the pressed state for a prescribed time to dry and shape the pulp layers 4*a* and 4*b* to the shape of the female mold 5 to provide a desired pulp molded article. As shown in FIG. 17(*e*), the pressing of the papermaking mold 300 is stopped, whereby the pulp molded article 6 separates from the surface of the papermaking mold 300 and stays in the impression 5*a* of the female mold 5. The expanding and contracting member 360 is then drawn to restore the papermaking mold 300 to the state before being inserted into the female mold as shown in FIG. 17(*f*). Subsequently, the papermaking mold 300 is removed from the impression 5*a* as shown in FIG. 17(*g*). Finally, the female mold 5 is opened to remove the pulp molded article 6 from the impression 5*a* as shown in FIG. 17(*h*).

The production method of this embodiment is particularly effective in cases where the cavity of a female mold cannot be completely filled with a deformed and expanded papermaking mold by the elastic deformation of the papermaking mold simply caused by pressing. According to this embodiment, a molded article whose opening has a smaller transverse cross-section than its body can easily be manufactured. Further, a molded article with an undercut can easily be produced by this embodiment.

Figure 18:
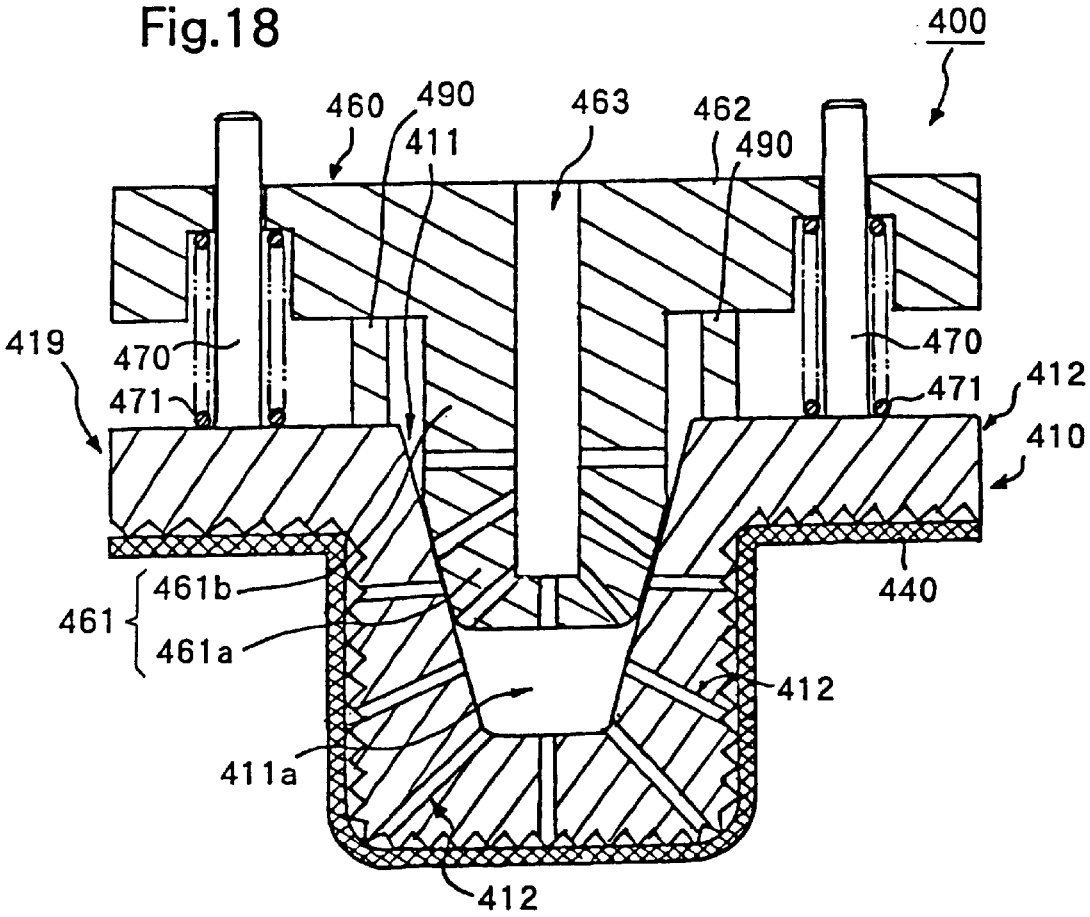
FIG. 18 is a cross-section showing another modification of the papermaking mold shown in FIG. 14.

A papermaking mold 400 according to the embodiment shown in FIG. 18 is used for production of a molded article having the shape of a flanged box (a molded article having an undercut). FIG. 18 shows a vertical cross-section of the papermaking mold 400 used in the present embodiment. The papermaking mold 400 used in the present embodiment comprises a main body 410, an expanding and contracting means 460, a mesh member 440, and a seal block 490.

The main body 410 has formed therein a cavity 411 of prescribed shape and a plurality of fluid passage holes 412 interconnecting the cavity 411 and the outside. The main body 410 has a flange 419 extending outward from the upper part thereof. The main body 410 is made of an elastically deformable material.

In detail, the main body 410 is a rectangular parallelepiped having every corner rounded and every upper edge extending outward to make the flange 419. The flange 419 is rectangular in its plan view. A cavity 411 having the shape of an inverted corn is formed in the inside of the main body 410. Before a push part 461 of the expanding and contracting means 460 is pushed in the cavity 411 as hereinafter described, the cavity 411 is not completely filled with the push part 461, leaving a slight space 411*a* unoccupied.

The main body 410 has a plurality of fluid passage holes 412 radiating out from its cavity 411 to the surface of the main body 410, with which the inside and the outside of the main body 410 are interconnected. All the sides, the base, and the lower side of the flange 419 which constitute the outer surface of the main body 410 have an uneven mesh pattern. The height of the main body 410 from its base to the lower side of the flange 412 is slightly larger than the height of a pulp molded article to be produced. The transverse cross-section of the main body 410 is smaller than the transverse cross-section of a molded article to be made.

The expanding and contracting member 460 comprises a push part 461 and a pressing plate 462. The push part 461 comprises a tip 461*a* having the shape of a truncated inverted cone similar to the shape of the cavity 411 and a cylindrical base 461*b* one end of which is connected to the tip 461*a* with the other end being connected to the pressing plate 462. The push part 461 slides in the direction of the height of the main body 410. In the push part 461, the base 461*b* connects with the center of the lower side of the pressing plate 462. The pressing plate 462 has a plate shape whose contour is almost equal to or larger than the contour of the flange 419 of the main body 410 in their plan view. The pressing plate 462 is a rigid body made of metals, etc.

The expanding and contracting means 460 has an interconnecting hole 463 with which the inside and the outside are interconnected. The interconnecting hole 463 is a vertical pit piercing through the push part 461 and the pressing plate 462. When the papermaking mold 400 is used, the interconnecting hole 463 open on the upper side of the pressing plate 462 is connected to a prescribed suction means.

The pressing plate 462 of the expanding and contracting member 460 and the flange 412 of the main body 410 are connected by connecting guides 470, 470 so that the expanding and contracting member 460 may be slid freely in the height direction of the main body 410. Each connecting guide 470 connects the pressing plate 462 and the flange 419 with a coil spring 471 fitted therearound.

The mesh member 440 covers all the sides, the base, and the lower side of the flange 412 which constitute the outer surface of the main body 410.

The seal block 490 is disposed between the main body 410 and the expanding and contracting member 460 to secure the space for the current through the fluid passage holes 412. The seal block 490 is rectangular in its plan view and is preferably made of an elastic material.

The expanding and contracting member 460 is pushed down in the height direction of the main body 410 whereby the flange 419 of the main body 410 is pressed by the pressing plate 462 of the expanding and contracting member 460. At the same time, the cavity 411 is pushed wider and filled with the push part 461 of the expanding and contracting member 460, whereby the main body 410 is elastically deformed and expanded to a prescribed shape. The seal block 490 is also pressed and deformed. The interconnecting hole 463 formed in the expanding and contracting member 460 and the fluid passage holes 412 formed in the main body 410 are designed to be interconnected with each other before and also after the sliding. FIG. 18 depicts the state before the sliding (pushing) of the expanding and contracting member 460, in which the interconnection of the seal block 490 and the interconnecting hole 463 with the fluid passage holes 412 via the space 411*a* can be seen. While not shown, the interconnecting holes 463 and the fluid passage holes 412 are directly connected to each other after the expanding and contracting member 460 is slid down, i.e., after the expanding and contracting member 460 is pushed down.

A pulp molded article production method using the papermaking mold 400 shown in FIG. 18 is described below. As noted above, the height of the main body 410 from its base to the lower side of the flange 419 is slightly larger than the height of a pulp molded article to be produced. In other words, the height from the base to the lower side of the flange 419 of the main body 410 is slightly larger than the depth of the impression of a female mold. Accordingly, when the papermaking mold 400 having a pulp layer formed thereon in the same manner as shown in FIG. 15, especially FIGS. 15(*a*) and 15(*b*), is fitted into the impression of the female mold, it is the base of the pulp layer that comes first into contact with the bottom of the impression. This is the same as in the method shown in FIG. 15. More specifically, the operation shown in FIG. 15(*c*) is carried out.

Figure 19:
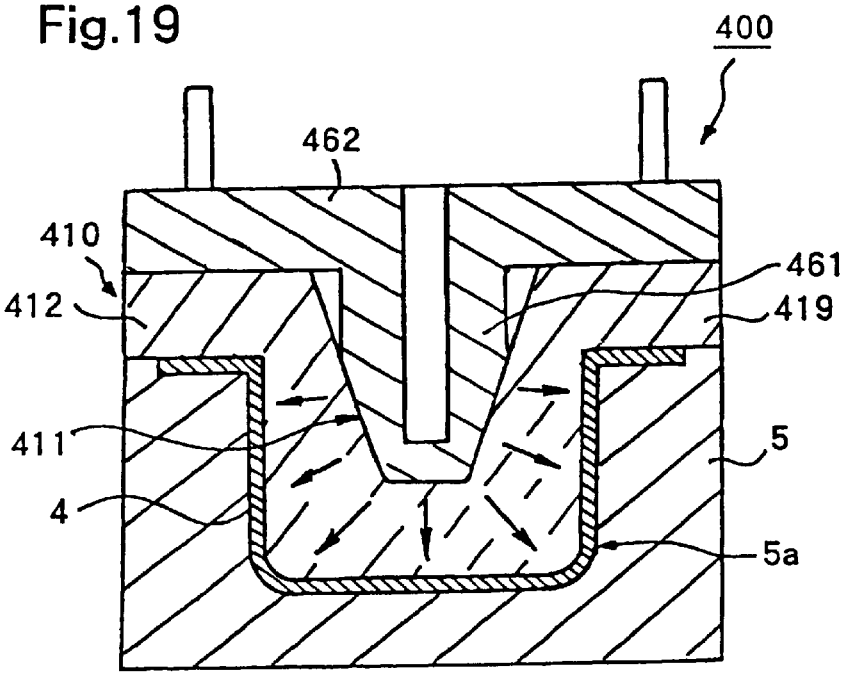
FIG. 19 schematically shows the step of pressing the papermaking mold in a pulp molded article production method using the papermaking mold shown in FIG. 18 (corresponding to FIG. 15(*d*)).

The expanding and contracting member 460 is then pushed down, whereby the flange 419 is pressed under the pressing plate 462, and, at the same time, the cavity 411 is pushed wider and filled with the push part 461. As a result, the main body 410 expands to fill the space in the impression 5*a* by elastic deformation as shown in FIG. 19 (corresponding to FIG. 15(*d*)). Thus, the pulp layer 4 is shaped in conformity with the shape of the impression 5*a* to make a molded article flanged around its opening. During the shaping, the pulp layer 4 is so loose that it is liable to develop lumps on the upper side at the root of the flange. In this embodiment, however, because the height of the main body 410 from its base to the lower side of the flange 419 is only slightly greater than the depth of the impression of the female mold, the deformation of the main body 410 in the height direction is very slight, and development of such lumps is prevented effectively. That is, the method according to the present embodiment succeeds in minimizing the elastic deformation of the main body 410 in its height direction to prevent formation of the above-mentioned lumps. The elastic deformation of the main body 410 occurs mainly in the lateral direction of the main body 410.

In order to effectively prevent development of the aforesaid lumps, the height of the main body 410 from its base up to the lower side of the flange 419 is preferably 1.05 to 2 times, particularly 1.05 to 1.3 times, the depth of the impression of the female mold.

Further, because the flange 419 of the main body 410 is pressed down by the rigid pressing plate 462 in the above-described embodiment, loosening of the pulp layer 4 and the resultant development of lumps can be prevented more effectively.

Thereafter, the same operations as in FIGS. 15(*e*) and 15(*f*) are performed to give a molded article flanged at the opening.

The embodiments shown in FIGS. 14 to 19 embrace other modifications. For example, the manner of fixing the core 210 and the core holding member 220 in the papermaking mold 200 used in the embodiment shown in FIGS. 14 and 15 is not limited to engagement, and other means can be used as well.

Further, the tapered sections of the core 210 of the papermaking mold 200 used in the embodiment shown in FIGS. 14 and 15 can be made on appropriate positions of the area in contact with the core holding member 220 according to the contour of a desired molded article.

Figure 20:
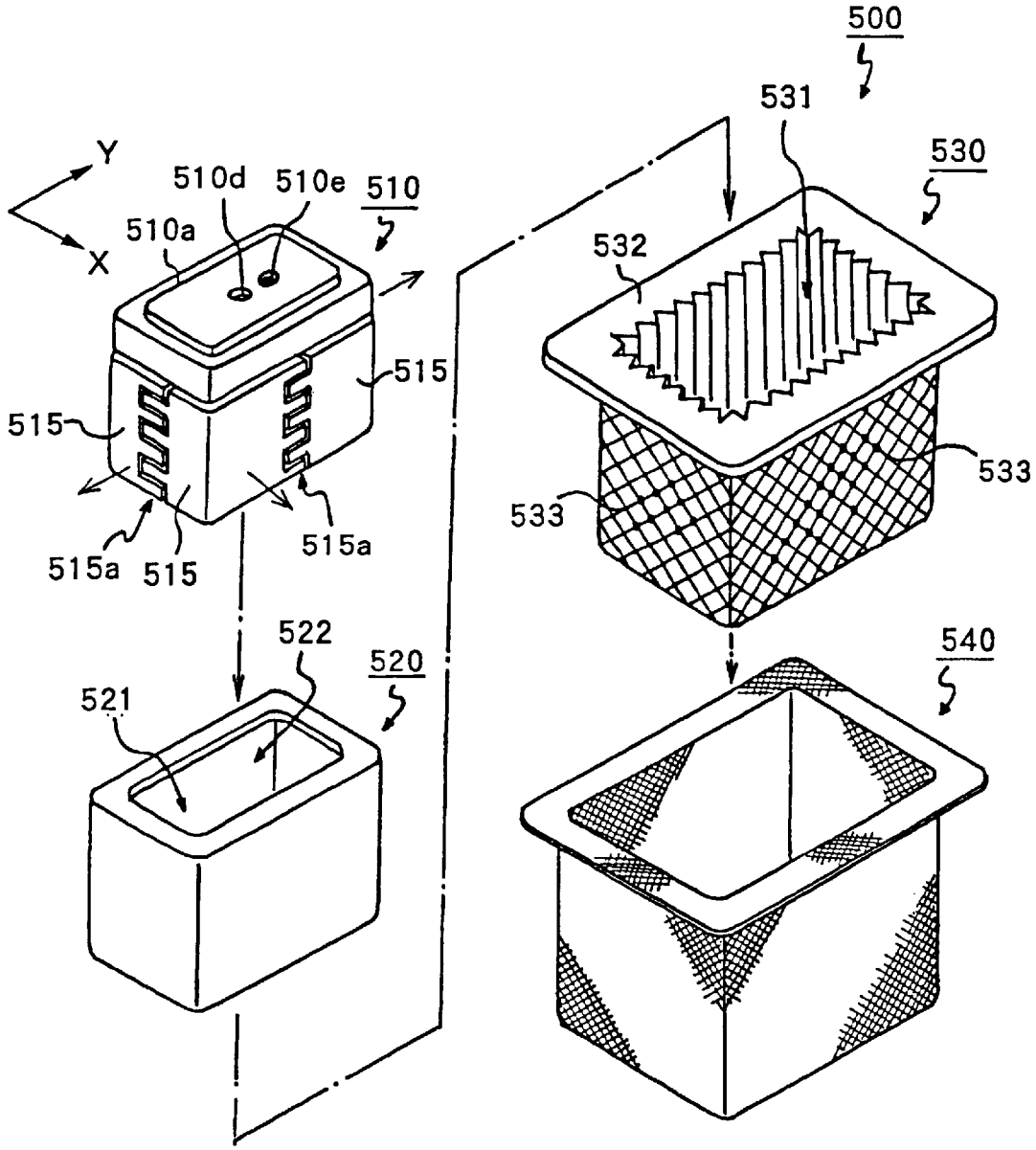
FIG. 20 is a perspective exploded view of a papermaking mold, which is yet another modification of the papermaking mold shown in FIG. 1.
Figure 21:
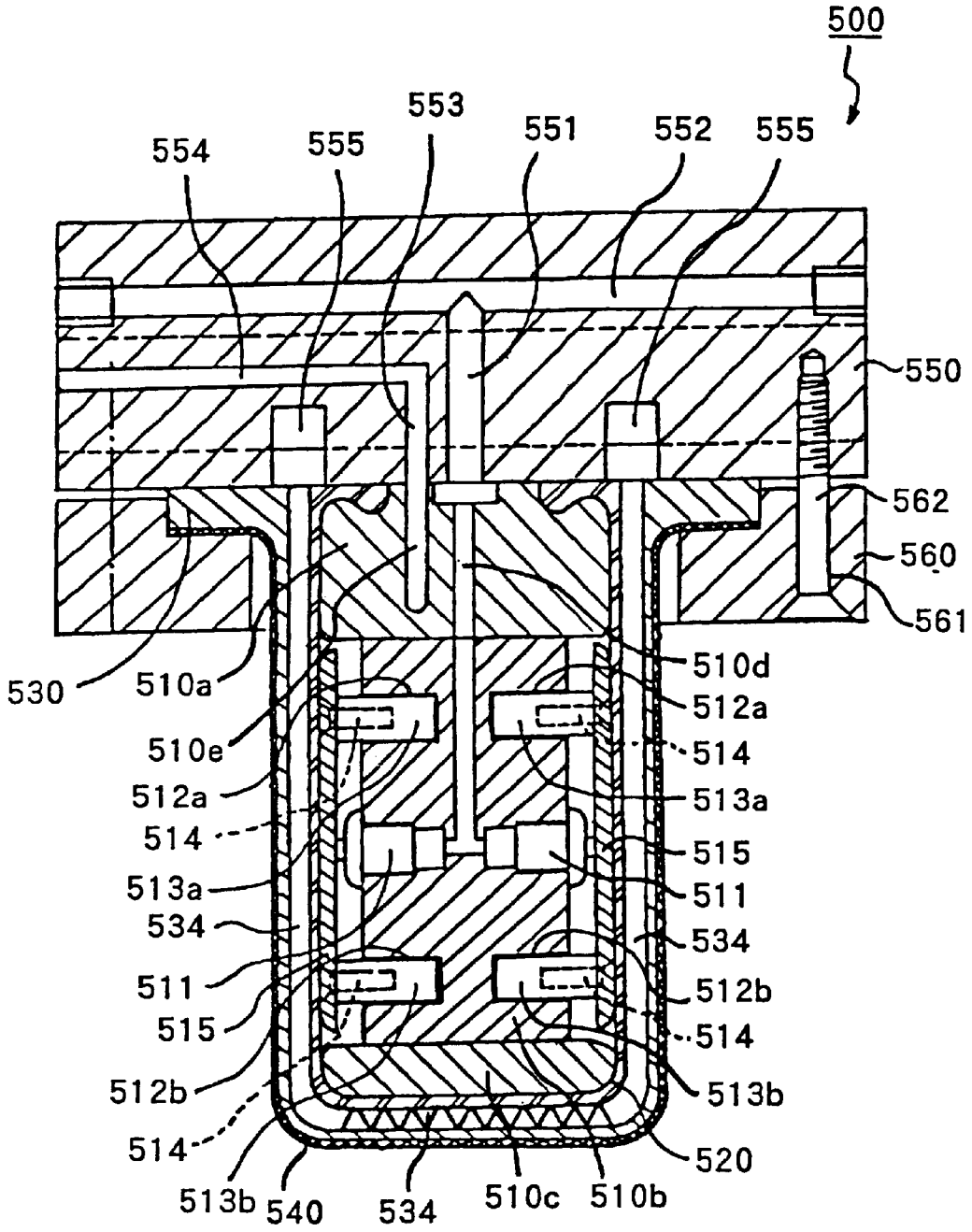
FIG. 21 is a vertical cross-section of the papermaking mold shown in FIG. 20.

FIGS. 20 and 21 show a perspective exploded view and a vertical cross-sectional view, respectively, of a papermaking mold which is yet another embodiment of the present invention. The vertical cross-section of FIG. 21 is the one taken along direction x of FIG. 20. While not shown, a vertical cross-section of FIG. 20 taken in direction y (perpendicular to direction x) presents almost the same view as FIG. 21.

A papermaking mold 500 comprises a core 510 which is a rectangular parallelepiped, a pressing member 520 in which the core 510 is fitted, a core holder 530 which holds the core 510 fitted in the pressing member 520, a mesh member 540 covering the outer surface of the core holder 530, a mounting plate 550 to which the core 510 is fixed, and a flange 560. The mounting plate 550 and the flange 560 are omitted from FIG. 20.

The core 510 is composed of an upper support member 510*a*, a lower support member 510*b* connected to the lower side of the upper support member 510*a*, and a base plate 510*c* which is connected to the lower side of the lower support member 510*b* and constitutes the base of the core 510. The lower support member 510*b* is a rectangular parallelepiped and has a pair of air cylinders 511 on the facing sides thereof. An air feed passage 510*d* is made through the upper support member 510*a* and the lower support member 510*b* to supply air from the outside of the papermaking mold 500 to the air cylinders 511. A fluid feed passage 510*e* is formed in the upper support member 510*a* through which to feed a prescribed fluid from the outside of the papermaking mold 500 to the inside of the core 510.

The air cylinders 511 are arranged in approximately the middle in the height direction of the lower support member 510b. A pair of guide holes 512*a* and a pair of guide holes 512*b* are made symmetrically about the air cylinders 511. Into each of the guide holes 512*a* and 512*b* is inserted a guide rod 513*a* or 513*b*. The end of each guide rod 513*a* or 513*b* is fixed to a expanding and contracting plate 515 with a screw 514.

The expanding and contracting plates 515 are members constituting all sides of the core 510. There are four expanding and contracting plates 515, three of which are shown in FIG. 20. As shown in FIG. 20, each expanding and contracting plate 515 is composed of a half of a side in x direction and a half of another side in y direction, the x and y directions being perpendicular to each other. Each expanding and contracting plate 515 engages with an adjoining one via a toothed joint 515*a*. Each expanding and contracting plate 515 is capable of moving in the x or y direction by the action of the air cylinders 511 as guided by the guide rods 513*a* and 513*b* inserted in the guide holes 512*a* and 512*b*. As a result, the core 510 is capable of expanding and contracting into similar figures in its plan view.

The pressing member 520 is a hollow member having a cavity 521 of approximately the same shape as the contour of the core 510 and an opening 522 at the top. The core 510 is fitted into the cavity 521 through the opening 522. As is seen from FIG. 21, the pressing member 520, as containing the core 510, covers all the sides, the base, and the peripheral portion of the top of the core 510 to have air-tightness. In the papermaking mold 500 as assembled, the upper side of the pressing member 520 and the upper side of the core 510 are even as shown in FIG. 21. The pressing member 520 is made of a material capable of expansion and contraction with the expansion and contraction of the core 510. Preferred materials include urethane, fluororubbers, silicone rubbers, and elastomers, which are excellent in tensile strength, impact resilience, extensibility, and the like.

The core holder 530 is a hollow member which is a rectangular parallelepiped, having a cavity 531 in which the core 510 as fitted into the pressing member 520 is held, with its top open. The core 510 fitted into the pressing member 520 is put into the cavity 531 from the top of the core holder 530. The upper edges of the core holder 530 are bordered with an extension 532 extending outward and horizontally from the edges. The extension 532 is held between the mounting plate 550 and the flange 560.

The depth of the cavity 531 is such that the upper side of the extension 532, the upper side of the pressing member 520, and the upper side of the core 510, which is fitted into the pressing member 520 and further placed in the cavity 531, are even as shown in FIG. 21. Every side and the base constituting the outer surface of the core holder 530 have an uneven mesh pattern or a flat surface.

The inner wall of the cavity 531 is serrated, having a large number of V-shaped grooves over the total height. While not shown, the bottom of the cavity 531 is also serrated, having a large number of V-shaped grooves. The core holder 530 has a plurality of through-holes 533 connecting the cavity 531 to the outer sides and the outer base. Each through-hole 533 is piercing between an intersection of the uneven mesh pattern on the exterior surface of the core holder 530 and the valley of the V-shaped groove on the interior surface of the cavity 531. Where the exterior surface of the core holder 530 is flat, each through-hole 533 pierces the valley of the V-shaped groove on the interior surface of the cavity 531. As a result, with the core 510 fitted into the pressing member 520 being placed in the cavity 531, there are formed a great number of spaces 534 of V-shaped grooves between the inner wall of the cavity 531 and the exterior surface of the pressing member 520, and interconnecting paths are formed from the spaces 534 to the through-holes 533. It is preferred for the through-holes to have a diameter usually of about 0.2 to 6 mm, preferably of about 1 to 4 mm, for facilitating uniform suction and for ease of boring. The density of the through-holes 533 is preferably 1 to 10, particularly 1 to 3, per $cm^2$ of the exterior surface of the core holder.

The core holder 530 is made of a material capable of expansion and contraction with the expansion and contraction of the core 510 and the pressing member 520. Such a material includes flexible rubber, urethane rubber, and silicone rubber.

The mesh member 540 is designed to cover the exterior sides and the exterior base of the core holder 530 tightly in conformity to the exterior surface profile. Where the exterior surface of the core holder 530 has an uneven mesh pattern as mentioned above, the mesh member 540 tightly covering the exterior surface leaves prescribed spaces between itself and the exterior surface of the core holder 530. Even where the exterior surface of the core holder 530 is flat, the mesh member 540, being a mesh, can leave prescribed spaces. The mesh member 540 is made of an extensible and contractible material. For example, the above-described fluid-permeable material and the like can be used.

The mounting plate 550 is, in its plan view, a rectangle larger than the contour of the extension 534 of the core holder 530. The flange 560 has the same contour as the mounting plate in its plan view. In the papermaking mold 500 as assembled, a screw 562 is put in through each through-hole 561 of the flange 560 from the lower side and screwed into the mounting plate 550 to clamp the extension 532 of the core holder 530 between the mounting plate 550 and the flange 560 (FIG. 21).

A vertical pit 551 is drilled in about the center of the mounting plate 550, and a tunnel 552 which connects with the pit 551 pierces the mounting plate 550 horizontally. The vertical pit 551 is bored at a position as to connect up with the air feed passage 510*d* of the core 510. In the papermaking mold 500 an assembled, the tunnel 552, the pit 551, and the air feed passage 510*d* link up to provide a passage interconnecting the outside of the papermaking mold 500 and the air cylinders 511 as shown in FIG. 21. Air is fed into this passage to operate the air cylinders 511.

The mounting plate 550 additionally has bored a second vertical pit 553 and a tunnel 554 which connects up with the second pit 553 and extends horizontally. The second pit 553 is made at a position as to link up with the fluid feed passage 510*e* of the core 510. In the papermaking mold 500 as assembled, the tunnel 554, the second pit 553, and the fluid feed passage 510*e* link up to provide a passage interconnecting the outside of the papermaking mold 500 and the inside of the core 510 as shown in FIG. 21. A prescribed pressurizing fluid is fed through this passage to expand or contract the pressing member 520 having the core 510 fitted therein.

As shown in FIG. 21, four grooves are made on the lower side of the mounting plate 550 to form manifolds 555 (two grooves out of 4 are shown in FIG. 21). In the assembled papermaking mold 500, each manifold 555 is at a position as to mate with the spaces 534 of V-shaped grooves which are formed by the core 510 fitted into the pressing member 520 being contained in the cavity 531 (see FIG. 21). Each manifold 555 is open on the side of the mounting plate 550 and is connected to a prescribed suction means (not shown).

When the papermaking mold 500 having the above-mentioned structure is set up, the manifolds 555, the spaces 534 of V-shaped grooves, and the through-holes 533 are interconnected with each other in the order described to form interconnecting paths for suction and dewatering in the papermaking mold 500 which interconnect the outside and the inside.

The contour of the thus constructed papermaking mold 500 agrees with the shape of the impression of a shaping female mold hereinafter described.

Figure 22:
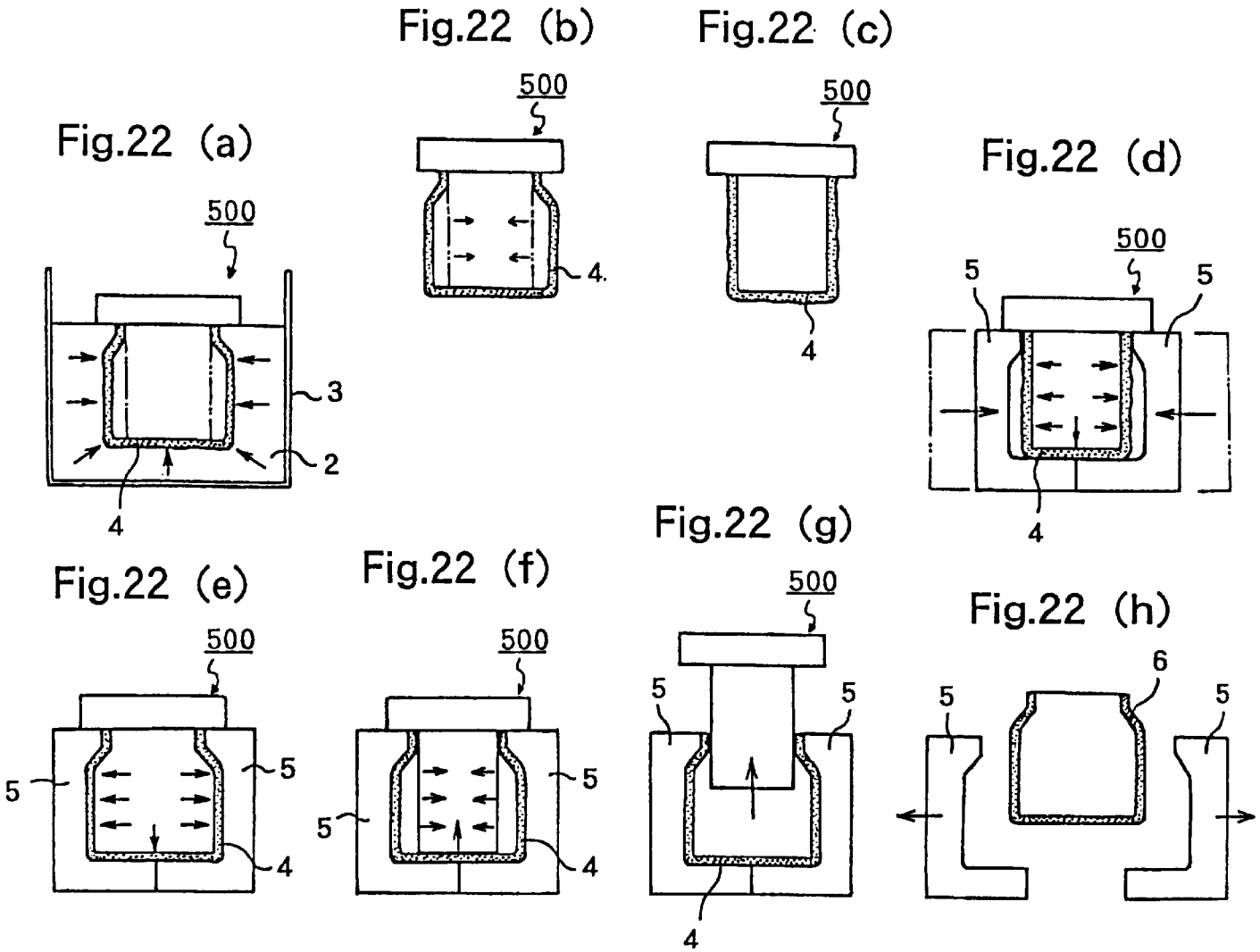
FIGS. 22(*a*) through 22(*h*) schematically illustrate the steps involved in a method of producing a pulp molded article by use of the papermaking mold shown in FIG. 20, in which FIG. 22(*a*) is the step of papermaking.

A pulp molded article production method using the papermaking mold 500 shown in FIGS. 20 and 21 is now described. FIGS. 22(*a*) through 22(*h*) schematically illustrate the steps involved in the method of producing a pulp molded article by use of the papermaking mold 500 shown in FIGS. 20 and 21. Specifically, FIG. 22(*a*) is the step of papermaking; FIG. 22(*b*), the step of pulling up the papermaking mold; FIG. 22(*c*), the step of contracting the papermaking mold; FIG. 22(*d*), the step of fitting the papermaking mold into a shaping female mold; FIG. 22(*e*), the step of expanding the papermaking mold; FIG. 22(*f*), the step of contracting the papermaking mold; FIG. 22(*g*), the step of removing the papermaking mold; and FIG. 22(*h*), the step of opening the shaping female mold.

First of all, the papermaking mold 500 is immersed in a pulp slurry 2 filling a container 3 as illustrated in FIG. 22(*a*). In the immersing step, the contour of the papermaking mold 500 is made equal to or slightly greater than the shape of the impression of a female mold for shaping hereinafter described. In the present embodiment, since the shape of the impression fits the contour of a molded article to be produced, the contour of the papermaking mold 500 is made equal to or slightly larger than the contour of the molded article. Where the contour of the papermaking mold 500 is made larger than that of the molded article to be produced, it is preferred that the surface area of the papermaking mold 500 while immersed be 1.01 to 1.4 times, particularly 1.01 to 1.1 times, that of the molded article to be produced so that the molded article may be obtained without suffering from cracks or thickness unevenness.

While the papermaking mold 500 is immersed in the pulp slurry 2, it is sucked from the outside to the inside by a suction means such as pump (not shown). The suction is conducted through the above-mentioned passage for suction and dewatering. That is, the water content of the pulp slurry 2 is sucked up through the suction and dewatering passage thereby to form a water-containing pulp layer 4 on the surface of the papermaking mold 500, i.e., the surface of the mesh member 540. Because of the prescribed spaces between the outer surface of the core holder 530 and the mesh member 540 as stated above, the pulp fiber is smoothly accumulated to form a pulp layer 4 of uniform thickness. It is desirable for the core holder 530, which is made of a material deformable with the expansion and contraction of the core 510 as noted previously, to have such stiffness so as not to be deformed by the suction.

Upon formation of the pulp layer 4 with a prescribed thickness, the papermaking mold 500 is pulled up from the pulp slurry 2 as shown in FIG. 22(*b*), and the suction is ceased. Then, the air cylinders 511 in the core 510 of the papermaking mold 500 operate to attract the expanding and contracting plates 515 toward the center thereby to contract the core 510. Contraction of the core 510 is accompanied with contraction of the pressing member 520, the core holder 530, and the mesh member 540. As a result, the water-containing pulp layer 4 formed on the surface of the mesh member 540 also contracts as depicted in FIG. 22(*c*). Wrinkles are sometimes formed on the contracted pulp layer 4. In such cases, the size of the pulp layer 4 after contraction is made smaller than the shape of the impression of a female mold 5 described later. For preventing fall-off of pulp fiber and formation of large wrinkles on the pulp layer 4, it is preferred that the degree of contraction of the pulp layer 4 be such that the ratio of the surface area of the contracted pulp layer 4 to the surface area of the pulp layer before contraction is 1/1.01 to 1/1.4, particularly 1/1.01 to 1/1.1.

As shown in FIG. 22(*d*), the contracted molded article 4 is fitted together with the papermaking mold 1 into the impression of a shaping female mold 5 composed of a set of splits. While the female mold used in the present embodiment is made up of two splits, the female mold can be composed of three or more splits in accordance with the configuration of a molded article to be manufactured. The pulp layer 4 fitted in the impression is dewatered by pressing, shaped, and dried by heating. In more detail, as shown in FIG. 22(*d*), the papermaking mold 500 having the pulp layer 4 formed thereon is sandwiched from both sides thereof between a pair of splits which, on being butted together, form an impression agreeing with the contour of a molded article to be made. As described above, the pulp layer 4, being smaller than the size of the impression, undergoes no deformation in this stage of sandwiching. Each split has previously been heated to a prescribed temperature.

Then, the air cylinders 511 in the core 510 of the papermaking mold 500 operate to push the expanding and contracting plates 515 outward thereby to expand the core 510. Coincidentally, the pressing member 520, the core holder 530, and the mesh member 540 expand. It follows that the pulp layer 4 that has contracted also expands and is pressed onto the inner wall of the impression as shown in FIG. 22(*e*). A prescribed pressurizing fluid is fed from the outside of the papermaking mold 500 into the core 510 to expand the pressing member 520 having the core 510 fitted therein. By this expansion the core holder 530 and the mesh member 540 are further deformed and expanded to press the pulp layer 4 onto every corner of the impression. As a result, the inner configuration of the impression is transferred to the pulp layer 4 very satisfactorily. In this way, since the pulp layer 4 is formed by papermaking on the papermaking mold 500 having a prescribed size and, after once contracted, is again expanded and subjected to dewatering by pressing, shaping, and heat drying, it is effectively prevented from developing cracks, thickness unevenness or like defects. Since pressing is effected by a combination of the mechanical expansion of the core 510 and the expansion of the pressing member by means of a pressurizing fluid, the inner configuration of the impression can be transferred to the molded article 4 with good precision and without pressing unevenness no matter how complicated the inner configuration of the impression may be. Additionally the resulting surface of the pulp layer 4 becomes extremely smooth. The term "smooth" as used herein means that the surface profile of the exterior or interior side of the resulting molded article has a center-line average roughness (Ra) of not more than 50 $\mu$m and a maximum height (Ry) of not more than 500 $\mu$m.

The fluid which is used to expand the pressing member 520 includes, for example, compressed air (heated air), oil (heated oil), and other various liquids. The pressure for fluid feed is usually 0.1 to 2.0 MPa, particularly 1.0 to 1.5 MPa, for preference, while depending on the kind of the fluid. It is preferred for the fluid to have been heated to a prescribed temperature for reducing the drying time of the pulp layer 4.

The pulp layer 4 is dried by heating while being pressed toward the inner wall of the impression. Because the evaporated water content can be discharged outside through the suction and dewatering passage, the pulp layer 4 is effectively protected against adhesion of dirt to its outer surface, which imparts an improved surface finish to the pulp layer 4. After the pulp layer 4 thoroughly dries, the air cylinders 511 in the core 510 of the papermaking mold 500 operate to attract the expanding and contracting plates 515 to the center of the core 510, whereupon the core 510 contracts again as shown in FIG. 22(*f*). The pressurizing fluid is then withdrawn from the pressing member 520. As a result, the pressing member 520, the core holder 530, and the mesh member 540 also contract. Having been given shape retention by the heat drying, the pulp layer 4, on the other hand, does not contract but holds to the inner wall of the impression as released from the surface of the contracted mesh member 540. In this state, the contracted papermaking mold 500 is removed from the pulp layer 4 as shown in FIG. 22(*g*). Where the mesh member 540 has a double layer structure composed of a first net layer and a second net layer, the release is very smooth because the pulp fibers have been prevented effectively from being entangled with the mesh member 540. Finally, the female mold 5 is opened to take out the dried molded article 6 as shown in FIG. 22(*h*).

In the embodiment shown in FIGS. 20 to 22, other modifications are allowable. For example, in the step of FIG. 22(*d*), it is possible that the papermaking mold 500 is removed from the contracted pulp layer 4, and only the pulp layer 4 is fitted into the impression. In this modification, the pulp layer can be expanded in the impression of the shaping female mold 5 by either feeding a pressurizing fluid directly into the pulp layer or inserting a separately prepared hollow pressing member into the pulp layer and feeding a pressurizing fluid into the pressing member for indirect pressing.

Further, in the step of FIG. 22(*d*), the shaping female mold 5 can be replaced with a pressing and dewatering female mold having a prescribed impression. The pressing and dewatering female mold carries out only pressing and dewatering of the pulp layer 4 by the same operations of FIGS. 22(*d*) to 22(*h*). Then, the pressing and dewatering female mold is opened to take out the pressed and dewatered pulp layer, which is transferred into the shaping female mold 5 having been heated to a prescribed temperature, where the pulp layer is shaped and heat dried. The shaping and heat drying can be performed by either feeding a pressurizing fluid directly into the pulp layer or inserting a separately prepared hollow pressing member into the pulp layer and feeding a pressurizing fluid into the pressing member for indirect pressing. The inner shape of the pressing and dewatering female mold may be the same as or different from that of the molded article to be produced.

In carrying out contraction of the pulp layer 4 in FIG. 22(*c*), the outer surface of the pulp layer 4 may be pressed by use of an auxiliary plate, etc. for preventing the pulp fiber from falling off.

Figure 23:
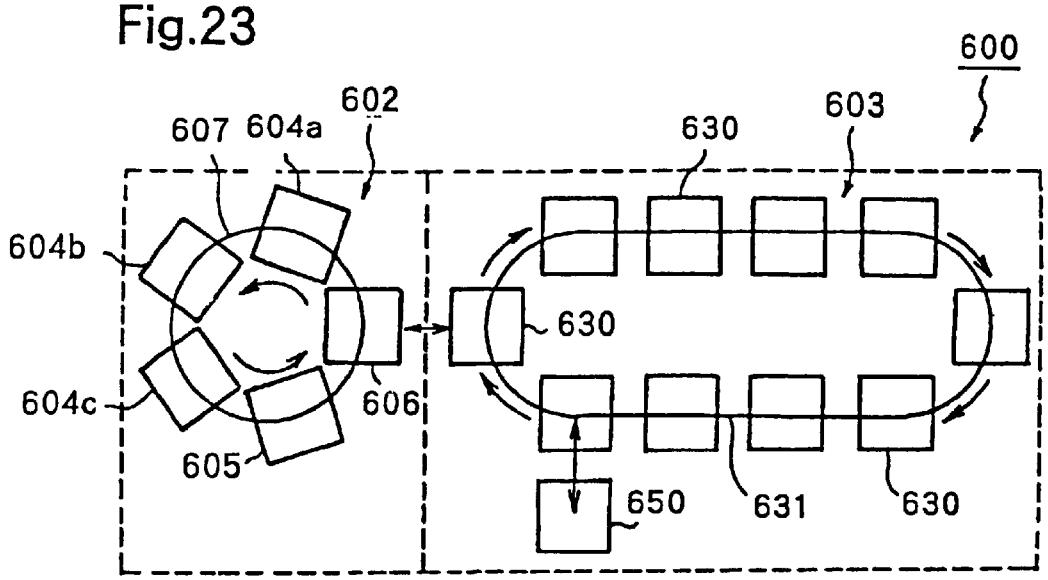
FIG. 23 is a schematic plan view of an embodiment of an apparatus for producing a pulp molded article having the papermaking mold according to the present invention.

The apparatus for producing a pulp molded article which has a papermaking mold according to the aforementioned embodiments will now be illustrated with reference to FIGS. 23 through 27. In FIG. 23 is depicted a schematic plan view of one mode of the pulp molded article production apparatus according to the present invention. The production apparatus 600 is largely divided into a first zone 620 where papermaking and dewatering of a molded article by pressing are carried out and a second zone 603 where the molded article is dried by heating.

Three papermaking stations 604*a*, 604*b* and 604*c* are disposed in the first zone 602. The papermaking stations 604*a*, 604*b* and 604*c* each have the respective liquid tanks containing a pulp slurry. The pulp slurries in the papermaking stations 604*a*, 604*b* and 604*c* have different compositions. The first zone 602 also has a dewatering station 605 where a water-containing pulp layer formed on the outer surface of a papermaking part of a papermaking mold hereinafter described is dewatered by pressing. The first zone 602 additionally has a transfer station 606 in which the pressed and dewatered pulp layer obtained in the dewatering station 605 is transferred to a drying station for the next step. The papermaking stations 604*a*, 604*b* and 604*c*, the dewatering station 605, and the transfer station 606 are arranged at a regular interval in this order to make a circular orbit 607.

The first zone has papermaking molds (not shown) which revolve in the circular orbit, intermittently moving on these stations. There are disposed as many papermaking molds as the stations (six stations in this embodiment).

Each papermaking mold is positioned on each station. It is movable horizontally among the stations and also vertically on each station by means of a prescribed driving unit (not shown).

Any of the papermaking molds according to the above-described embodiments can be used according to the shape, etc. of molded articles to be manufactured with no particular restriction.

Figure 24:
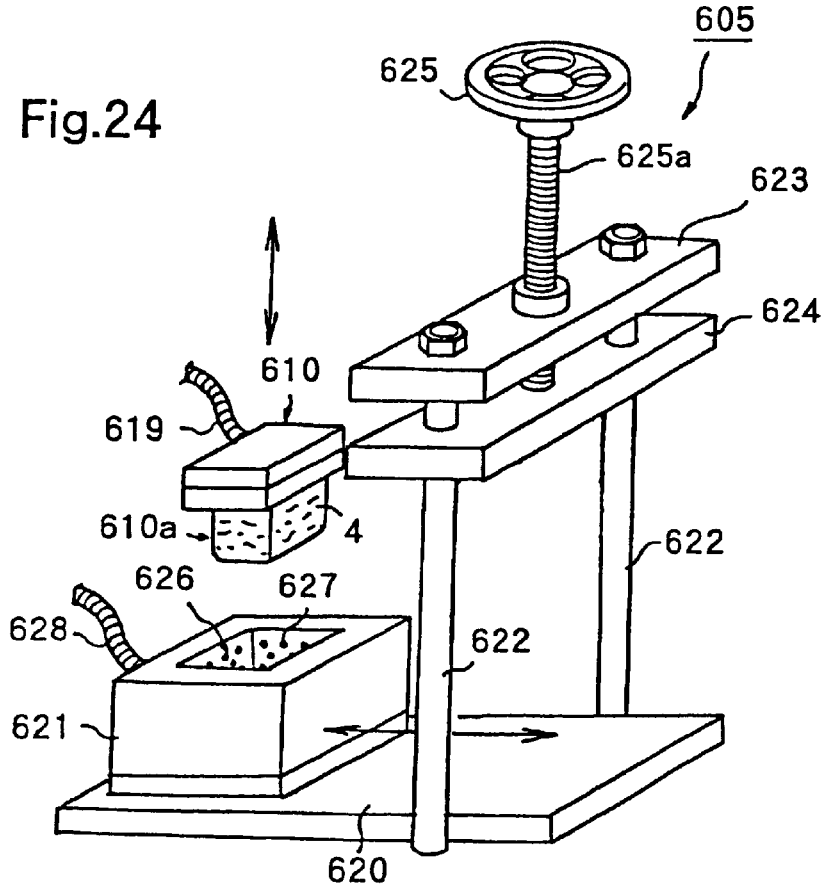
FIG. 24 is a perspective of a dewatering station.

FIG. 24 is a perspective view of the dewatering station 605. The dewatering station 605 has a horizontally movable slide plate 620, a dewatering female mold 621 mounted on the slide plate 620, two piers 622, 622 which stand upright to span the slide plate 620, a bridging member 623 which connects the two piers 622 and 622, a press plate 624 which vertically slides along the piers 622, and a height adjustment wheel 625 which makes the press plate 624 move up and down.

The rotating shaft 625*a* of the height adjustment wheel 625 has a feed thread therearound. The press plate 624 is fixed to the tip of the rotating shaft 625*a*. The height adjustment wheel 625 is rotated to vertically move the press plate 624.

The dewatering female mold 621 has an impression 626 into which the papermaking part 610*a* of the papermaking mold 610 is fitted. The impression 626 is made larger than the shape of the papermaking part 610*a* of the papermaking mold 610. A large number of suction holes 627 are open on the inner surface of the impression 626. The suction holes 627 lead to a suction hose 628 which is connected to the dewatering female mold 621. The suction hose 628 is connected to a suction means such as a suction pump (not shown).

While not depicted, an extensible sheet is fixed to the periphery of the impression 626 of the dewatering female mold 5 by a prescribed means to cover the upper side of the impression 626. The sheet can be of the same material as the sheet 7 shown in FIG. 3.

FIG. 3 shows the situation in which the slide plate 620 has moved forward. The term "forward" as used herein means "to the direction opposite to the center of the circular orbit 607 (see FIG. 23)". Under this situation, the papermaking mold 610 having a water-containing pulp layer 4 formed on the outer surface of the papermaking part 610*a* is moved down to put the papermaking part 610*a* of the papermaking mold 610 into the impression 626 of the dewatering female mold 621.

After the papermaking part 610*a* is fitted into the impression 626, the slide plate 620 goes backward until the papermaking mold 610 comes right under the press plate 624. Besides being movable back and forth, the slide plate 620 is movable up and down. When the slide plate 620 is at the backward position, it moves up. As a result, the papermaking mold 610 is held between the press plate 624 and the dewatering female mold 621, and the water-containing pulp layer is pressed and dewatered. The distance between the top position and the bottom position of the slide plate 620, i.e., the stroke of the slide plate 620 is decided by the position of the press plate 624.

After the molded article is dewatered by pressing, the slide plate 620 goes down to relieve the papermaking mold 610 from being pressed. Then the slide plate 620 slides to the forward position, where the papermaking mold 610 is removed from the dewatering female mold 621. The removed papermaking mold 610 is delivered to the transfer station 606.

The transfer station 606 is a site where the papermaking mold 610 after the press-dewatering moves in and transfers the pulp layer formed on the outer surface of the papermaking part 610*a* of the papermaking mold 610 to a drying station disposed in the second zone. The details of this transfer will be described later.

Back to FIG. 23, the second zone 603 of the production apparatus 601 is explained. The second zone 603 has a plurality of drying stations 630 which receive the water-containing pulp layer transferred from the transfer station 606 of the first zone 602 and heat-dry the pulp layer and a deliver station 650 from which the molded article obtained by drying is delivered. The drying stations are arranged at a prescribed interval to make a second orbit 631 which is elliptic. They revolve in the second orbit 631 at a predetermined speed.

Figure 25:
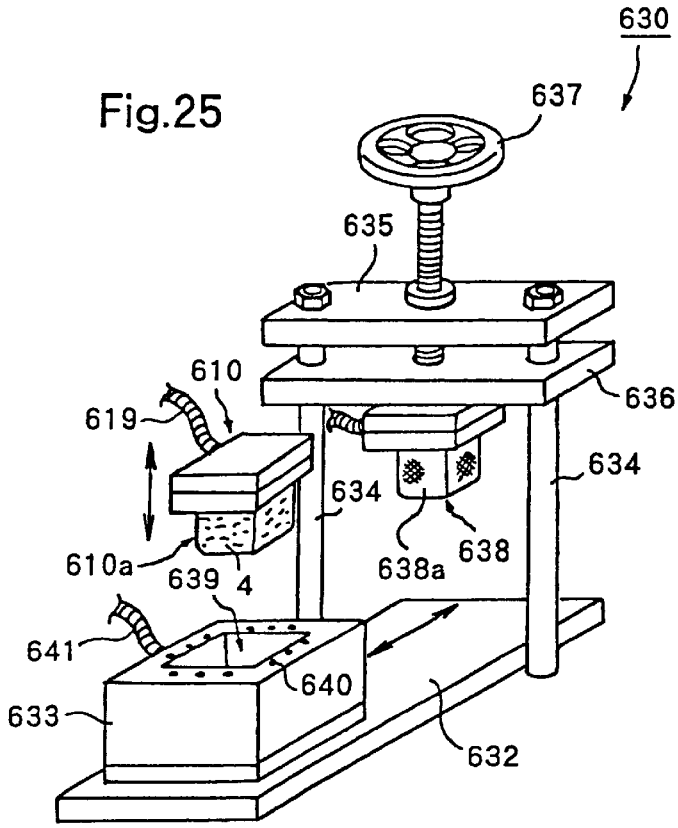
FIG. 25 is a perspective of a drying station.

FIG. 25 is a perspective view of the drying station 630. The drying station 630 is structurally similar to the aforementioned dewatering station 605 in the first zone 602. The great difference between them lies in that the dewatering station 605 is stationary whereas the drying station 603 revolves in the orbit 631 and that a drying male mold is disposed on the lower side of the press plate in the drying station 630. The details of the drying station 630 will be described hereunder.

The drying station 630 has a horizontally movable slide plate 632, a drying female mold 633 mounted on the slide plate 632, two piers 634, 634 which stand upright to span the slide plate 632, a bridging member 635 which connects the two piers 634 and 634, a press plate 636 which vertically moves along the piers 634, and a height adjustment wheel 637 which makes the press plate 636 move up and down. The structures and motions of the height adjustment wheel 637 and the press plate 636 are the same as those of the height adjustment wheel 625 and the press plate 624 in the dewatering station 605.

A drying male mold 638 is disposed on the lower side of the press plate 636. The drying male mold 638 is fitted into the impression of 639 of the drying female mold 633 mounted on the slide plate 632.

The shape and structure of the drying male mold 638 are the same as those of the papermaking mold 610 used in the first zone 602. The shape and structure of the drying female mold 633 are the same as those of the dewatering female mold used in the first zone 602. In detail, the drying female mold 633 has an impression 639 in which the drying male mold 638 is fitted. The impression 639 is made larger than the shape of the part 638*a* of the drying male mold 638 that is to be fitted in (the part corresponding to the papermaking part 610*a* of the papermaking mold 610). A great number of through-holes 640 are open on the periphery of the impression 639. The through-holes 640 lead to a hose 641 which is connected to the dewatering female mold 633. The hose 641 leads to a compressive air source (not shown). The drying female mold 633 is equipped with a heating means such as an electrical heater (not shown).

FIG. 25 shows the situation in which the slide plate 632 of a drying station 630 which is at the position facing the transfer station 606 of the first zone 602 has slid forward. The term "forward" as used herein means "to the outward direction out of the orbit 631 (see FIG. 23). The forward position agrees with the position of the transfer station 606. In other words, when the slide plate 632 of the drying station 630 slides forward, the drying female mold 633 on the slide plate 632 comes to the position of the transfer station 606. Under this situation, the papermaking mold 610 having the water-containing pulp layer 4 formed on the outer surface of the papermaking part 610*a* moves down, and the papermaking part 610*a* of the papermaking mold 610 is thus fitted into the impression 639 of the drying female mold 633. Then air is blown from the outside into the papermaking mold 610 through the suction hose 619 connected to the papermaking mold 610. The blown air is blown off from the outer surface of the papermaking part 610*a* of the papermaking mold 610. As a result, the pulp layer 4 formed on the outer surface of the papermaking part 610*a* is released therefrom and stays in the impression 639 of the drying female mold 633. After the pulp layer 4 is fitted, the papermaking mold 610 elevates up to a prescribed position. Transfer of the pulp layer 4 from the first zone 602 to the second zone 603 completes in this way.

On completion of the pulp layer 4 transfer, the slide plate 632 moves backward to a backward position where the impression of the drying female mold 633 is located just under the drying male mold 638. Besides being movable back and forth, the slide plate 632 is movable up and down. When the slide plate 632 is at the backward position, it moves up. As a result, the water-containing pulp layer 4 is sandwiched in between the drying male mold 638 and the drying female mold 633. The drying female mold 633 having been heated to a prescribed temperature, the water-containing pulp layer 4 is dried by heat while being sandwiched. The distance between the top position and the bottom position of the slide plate 632, i.e., the stroke of the slide plate 632 is decided by the position of the press plate 636 similarly to the dewatering station 605 in the first zone 602.

The drying station 630 intermittently revolves in the orbit 631 at a prescribed speed while keeping the pulp layer 4 in the sandwiched state.

When the drying station 630 comes to the position facing the delivery station 650 (see FIG. 23), the slide plate 632 moves down to relieve the pulp layer 4 from being sandwiched and pressed. Then, the slide plate 632 slides forward so that the drying female mold 633 on the slide plate 632 is positioned on the delivery station 650. In this position, the molded article obtained by drying the pulp layer 4 is removed from the drying female mold 633 by a prescribed suction and holding means. The removed molded article is delivered on a carrier belt (not shown) attached to the delivery station 650. Thereafter, the above-described operation is repeated with each drying station 630, and the water-containing pulp layers 4 transferred from the first zone 602 are successively dried and delivered as molded articles.

Figure 26:
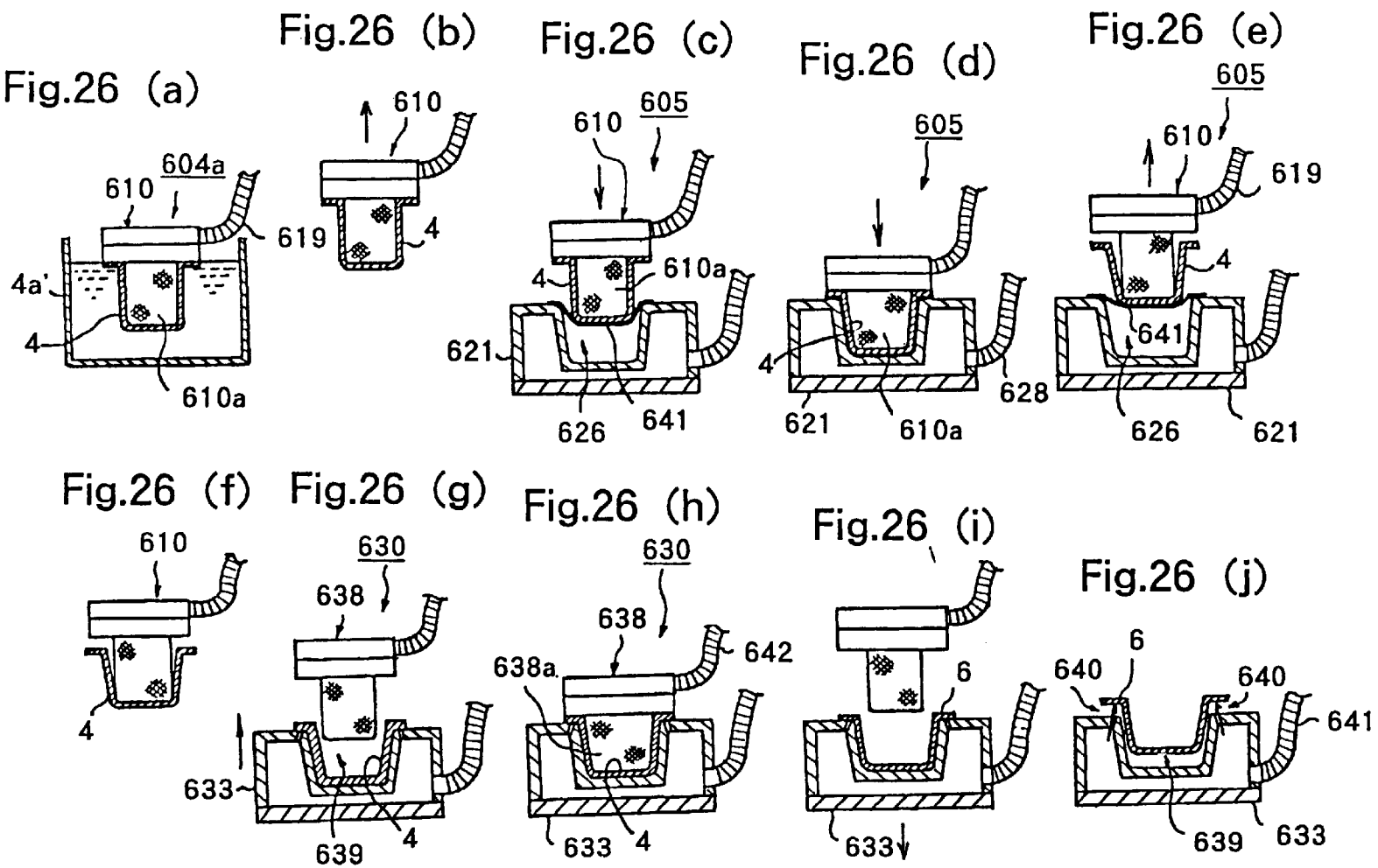
FIGS. 26(*a*) through 26(*j*) schematically illustrate the steps involved in a method of producing a pulp molded article by use of the apparatus shown in FIG. 23, in which FIG. 26(*a*) shows the step of papermaking.

The pulp molded article production system using the production apparatus 601 according to the present embodiment is described by referring to FIGS. 26(*a*) through 26(*i*). At first, the papermaking part 610*a* of the papermaking mold 610 is immersed in a first pulp slurry of a liquid tank 604*a*' in the papermaking station 604*a* as shown in FIG. 26(*a*). In this state, a suction means such as a suction pump (not shown) connected to the suction hose 619 operates to evacuate the papermaking mold 610 in the direction from the outside to the inside. As a result, pulp fibers are deposited on the surface of the papermaking part 610*a* to form a water-containing pulp layer 4. Meanwhile, the other papermaking molds 610 positioned in the stations other than the papermaking station 604*a*, i.e., the papermaking stations 604*b* and 604*c*, the dewatering station 605, and the transfer station 606 are undergoing the respective operations in the respective stations.

After a pulp layer 4 of prescribed thickness is formed, the papermaking mold 610 is pulled up from the pulp slurry as shown in FIG. 26(*b*) to complete the first papermaking operation. The same operation is conducted in the papermaking stations 604*b* and 604*c* ultimately to form a pulp layer having a three-layer structure.

The papermaking mold 610 is then subjected to dewatering by pressing in the dewatering station 605 as shown in FIGS. 26(*c*) to 26(*e*). In detail, the papermaking part 610*a* of the papermaking mold 610 is fitted into the impression 626 of the dewatering female mold 621 as shown in FIG. 26(*c*).

The papermaking part 610*a* is put into the impression 626 while causing the extensible sheet 641 covering the impression 626 of the dewatering female mold 621 to be deformed by extension as shown in FIG. 26(*c*). The height of the core (not shown) of the papermaking mold 610 is greater than the height (depth) of a molded article as stated with respect to the papermaking molds according to the above-described embodiments. Therefore, as the papermaking part 610*a* is further pressed into the impression 626, the base of the pulp layer 4 is the first to come into contact with the bottom of the impression 626. Then, the papermaking part 610*a* is further pressed down as shown in FIG. 26(*d*), whereby the core (not shown) of the papermaking part 610*a* is pressed and deformed to expand in conformity to the inner configuration of the impression 626 of the dewatering female mold 621 to completely fill the space of the depression 626. As a result, the pulp layer 4 formed on the surface of the papermaking part 610*a* is further pressed and dewatered, and the inner configuration of the impression 626 is transferred onto the pulp layer 4.

While keeping the papermaking mold 610 in the pressed state, the water content in the pulp layer 4 is sucked up through the suction hose 628 connected to the dewatering female mold 621. By this suction, the water contained in the pulp layer 4 is discharged.

The papermaking mold 610 is maintained in the pressed state for a prescribed period of time to press and dewater the pulp layer 4 to a prescribed water content. As shown in FIG. 26(*e*), the pressing of the papermaking mold 610 is then stopped, whereupon the core (not shown) of the papermaking mold 610 is restored as it has been before being pressed, and the pulp layer 4 separates from the sides of the papermaking part 610*a*. The papermaking mold 610 is further sucked from its exterior to its interior through the suction hose 619 of the papermaking mold 610, and the papermaking mold 610 is pulled up with the pulp layer 4 adsorbed onto the base of the papermaking part 610*a*. As the papermaking mold 610 goes up, the extended sheet 641 contracts, so that the pulp layer spontaneously separates from the impression 626 and is easily taken out from the dewatering female mold 621.

According to this method, deep containers whose side walls stand at right angles or nearly right angles, containers whose neck is narrower than the body, and containers having a so-called undercut can easily be produced.

Because the number of the stations in the first zone (the total number of the papermaking stations, the dewatering station, and the transfer station) is equal to the number of the papermaking molds, the stations perform their respective operations at the same time. Therefore, the production cycle can be shorted remarkably. Moreover, because each papermaking mold revolves in the orbit, the time loss involved for movement is minimized compared with the system wherein a papermaking mold reciprocates, which also brings about reduction of the production cycle.

The papermaking mold 610 moves to the transfer station, where the pulp layer 4 is taken out and transferred to the drying station of the second zone as shown in FIG. 26(*f*).

In detail, the papermaking mold 610 having the pulp layer 4 stuck thereto moves to the position of the transfer station as shown in FIG. 26(*f*), where the drying female mold 633 of a drying station stands by (see FIG. 25). The drying female mold 633 has been heated to a prescribed temperature beforehand. The papermaking mold 610 comes down to put the pulp layer 4 into the impression 639 of the drying female mold 633 on standby. After the pulp layer 4 is fitted, the suction of the pulp layer 4 by the papermaking mold 610 is stopped to relieve the pulp layer 4 from being stuck. The papermaking mold 610 is pulled up, whereby the transfer from the first zone to the second zone completes.

The pulp layer 4 is then dried by heating in the drying station 630 of the second zone as shown in FIGS. 26(*g*) and 26(*h*). In detail, on completion of the transfer of the pulp layer 4 into the drying female mold 633 in the drying station 630, the slide plate of the drying station 630 slides back to the backward position, and, as shown in FIG. 26(*g*), the drying female mold 633 lifts at the backward position, whereupon the drying male mold 638 attached to the drying station 630 is inserted into the pulp layer 4 fitted in the impression 639 of the drying female mold 633. The drying female mold 633 further lifts, whereby the pulp layer 4 is sandwiched and pressed in between the drying male mold 638 and the drying female mold 633 as illustrated in FIG. 26(*h*). Similarly to the situation in the dewatering station of the first zone, the inserted part 638*a* of the drying male mold 638 is pressed and deformed to expand in conformity to the shape of the impression 639 of the drying female mold 633 and thereby fills the space in the impression 639 completely.

In this sandwiched and pressed state, the pulp layer 4 is heat dried to make a molded article 6. Meanwhile, the steam generated by heating is sucked and discharged out of the drying male mold 638 through a suction hose 642 connected to the drying male mold 638. Thereafter, the drying station 630 revolves intermittently in the orbit 631 (see FIG. 23) at a prescribed speed while maintaining the molded article 6 in the sandwiched state.

When the drying station 630 moves to the position facing the delivery station 650, the drying female mold 633 moves downward as shown in FIG. 26(*i*) to relieve the molded article 6 from being sandwiched. Then, as described above, the slide plate 632 of the drying station 630 moves forward to the forward position. In this forward position, air is blown off from the through-holes 640 made in the periphery of the impression 639 of the drying female mold 633 through the hose 641 connected to the drying female mold 633 as shown in FIG. 26(*j*). As a result, the molded article 6 in the impression 639 is easily released from the impression 639. Subsequently, the released molded article 6 is taken out of the impression 639 by a prescribed suction and holding means.

Another embodiment of the practice of the production apparatus 601 shown in FIG. 23 is described with reference to FIG. 27. The embodiment shown in FIG. 27 will be explained only with regard to the differences from that shown in FIG. 23. While the same points are not particularly referred to, the description given to the embodiment shown in FIG. 23 applies appropriately.

Figure 27:
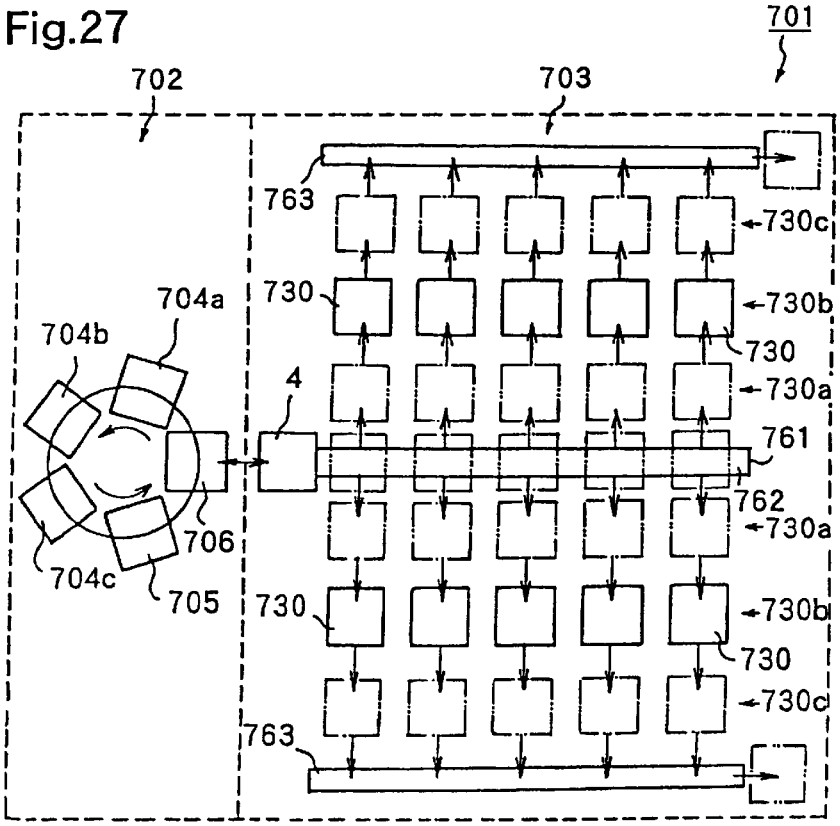
FIG. 27 is a schematic plan view of another embodiment of the production apparatus shown in FIG. 23 (corresponding to FIG. 23).

The production apparatus 701 according to the embodiment shown in FIG. 27 is largely divided in a first zone 702 and a second zone 703 similarly to the production apparatus of the embodiment shown in FIG. 23. The first zone 702 in the production apparatus 701 according to this embodiment is the same as the first zone in the production apparatus 601 of the embodiment shown in FIG. 23.

The second zone 703 in the production apparatus 701 according to the present embodiment has a receiving station 760 which receives the water-containing pulp layer transferred from the transfer station 706 in the first zone and a plurality of drying stations 730 where the molded article transferred from the receiving station 760 is dried by heating.

A straight guide rail 762 is provided between the transfer station 706 in the first zone and the end 761, and the receiving station 760 freely reciprocates along this guide rail. The receiving station 760 receives a pulp layer from the transfer station 706 of the first zone, holds the pulp layer by suction, and hands it over to a prescribed drying station 730.

The drying stations 730 are arranged along the travelling course of the receiving station, i.e., along the guide rail 762 at a prescribed interval. In this particular embodiment, ten drying stations are disposed in total, five on each side of the guide rail 762, as shown in FIG. 27.

Each drying station 730 is structurally the same as that used in the embodiment shown in FIG. 23. The differences between them are as follows. (1) In the drying station in the embodiment shown in FIG. 23, the prescribed operations are conducted when the slide plate is in the two positions, the forward position and the backward position. In the present embodiment, prescribed operations are performed when the drying station 730 is in three positions, a forward position, an intermediate position, and a backward position. (2) The drying station in the embodiment shown in FIG. 23 revolves, while the drying station 730 in the present embodiment is fixed.

In more detail, the drying station 730 according to the present embodiment has a slide plate which is movable horizontally and vertically, a drying female mold mounted on the slide plate, and a drying male mold which is fitted into the impression of the drying female mold in the same manner as in the drying station in the embodiment shown in FIG. 23.

When the slide plate is in the forward position, i.e., the position 730*a* in FIG. 27, the pulp layer transferred from the receiving station 760 is handed over to the drying female mold. In this case, nine out of ten drying stations 730 have respective pulp layers fitted in and are conducting heat-drying of the respective pulp layers, and the drying female mold of only one drying station 730 is vacant. The pulp layer is fitted into this vacant female mold for drying.

On fitting the pulp layer, the slide plate moves backward over a prescribed distance to a prescribed position. In this position, i.e., the aforesaid intermediate position (730*b* in FIG. 27), the slide plate lifts, whereby the pulp layer in the drying female mold is sandwiched in between the drying female mold and the drying male mold and heat-dried to provide a molded article.

On completion of the drying, the slide plate goes down to relieve the molded article from the sandwiched state. The slide plates moves backward further. In this position, i.e., the backward position (the position 730*c* in FIG. 27), the dried molded article is taken out of the drying female mold by a prescribed suction and holding means. The removed molded article is put on a carrier belt 763 attached to the backward position 730*c* and delivered. The above operation is conducted in each drying station 730, and the water-containing pulp layers transferred from the first zone 702 are successively dried and delivered as molded articles.

The embodiments shown in FIGS. 23 through 27 embrace modifications. For example, the orbit in the first zone in the embodiments shown in FIGS. 23 to 27 can be other than a circle. Likewise, the orbit in the second zone in the embodiments shown in FIGS. 23 to 26 can be other than an ellipse.

The number of the papermaking stations in the first zone in the embodiments shown in FIGS. 23 through 27 can be increased or decreased according to the number of the layers constituting a desired molded article.

The number of the stations in the first zone in the embodiments shown in FIGS. 23 through 27 does not need to be equal to the number of papermaking molds. The number of the papermaking molds can be less than the number of the stations.

In the embodiment shown in FIG. 27, the forward position 730*a* of the slide plate in each drying station 730 of the second zone may be over the guide rail 762 of the receiving station 760.

The present invention is not limited to the above-described embodiments. For instance, while each embodiment illustrated above relates to production of a molded article of box shape having an opening, the present invention is applicable to production of various other shapes, such as caps, spoons, lids, and so forth.

The present invention is applicable to not only hollow containers used to hold contents but various shapes such as ornaments.

The molded article obtained in each of the above embodiments can be subjected to post treatment, such as application of a plastic layer, a coating layer, etc. on the outer and/or the inner side of the molded article for the purpose of strength improvement, effective prevention of leaks or decoration.

The contents of the above-described embodiments are interchangeable with each is other.

Industrial Applicability

According to the present invention, a pulp molded article having excellent surface smoothness and a satisfactory appearance can be produced with ease.

According to the present invention, a pulp molded article having a complicated shape can be produced conveniently. In particular, when the core of a papermaking mold has a tapered section (FIG. 14), the inner configuration of a female mold impression can be transferred to a pulp layer more accurately. Where a papermaking mold has inside an expanding and contracting member capable of elastically deforming the papermaking mold, a molded article having a so-called overhang can easily be produced. In making a molded article having a flange around its opening, development of lumps on the upper side at the root of the flange can be prevented effectively by minimizing the elastic deformation in the height direction of the papermaking mold.

According to the present invention, releasability of a molded article is satisfactory, making it possible to manufacture molded articles with good production efficiency. Further, a molded article is effectively prevented from being damaged when released from a mold.

According to the present invention, a molded article of desired shape can easily be produced without developing cracks nor thickness unevenness.

According to the present invention, transfer from a papermaking step to a dewatering step can be carried out smoothly to produce a molded article with high precision efficiently. This is particularly advantageous in the production of thin-walled molded articles.

According to the present invention, a pulp molded article can be manufactured with high production efficiency.

According to the present invention, deep molded articles whose side walls stand at right angles or nearly right angles, containers whose neck is narrower than the body, and molded articles having a so-called undercut can easily be produced.

What is claimed is:

1. A mold for producing a pulp molded article which comprises a flat plate having a plurality of through-holes at a prescribed interval, an upper plate disposed above said flat plate, a number of cores each fixed to the lower side of said upper plate and fitted into each of said through-holes from the upper side of said flat plate, and a fluid-permeable material covering the lower side of said flat plate, wherein said flat plate has a plurality of holes for fluid passage which are open on the lower side thereof and interconnect the lower side and the inside of said flat plate, said core is made of an elastically deformable material and has a plurality of holes for fluid passage interconnecting the outside and the inside thereof, said upper plate is connected to said flat plate via a number of connecting guides in such a manner as to slide vertically and, as said upper plate slides, said core fixed to the lower side of said upper plate is removably fitted through each through-hole of said flat plate, and said fluid-permeable material is capable of forming fluid passages in the thickness direction thereof even when pressed and deformed.

2. A mold for producing a pulp molded article which comprises a core that is a rigid body of prescribed shape having a plurality of holes for fluid passage which interconnect the inside and the outside of said core, a core holding member that is positioned under said core and is made of an elastically deformable material, and a mesh member which closely covers the outer surface of said core holding member, wherein said core holding member has interconnecting holes which are open on said outer surface, said interconnecting holes linking up with said holes for fluid passage formed in said core when said core holding member is disposed under said core.

3. A mold for producing a pulp molded article which comprises a main body made of an elastically deformable material and having inside a cavity of prescribed shape and a plurality of holes for fluid passage that lead said cavity to the outside, an expanding and contracting member which slides within said cavity in the height direction of said main body, and a mesh member closely covering the outer surface of said main body, wherein said expanding and contracting member has interconnecting holes which interconnect the inside and the outside thereof, and when said expanding and contracting member is slid down, said cavity is pushed wider to expand said main body through elastic deformation, and said interconnecting holes and said holes for fluid passage connect up with each other in at least the state before the sliding.

4. A method of producing a pulp molded article which comprises:

immersing a papermaking mold having interconnecting passages that interconnect the outside and the inside thereof and capable of elastic deformation in a pulp slurry, sucking up the water content in the pulp slurry from the outside to the inside of said papermaking mold through said interconnecting passages to form a pulp layer on the surface of said papermaking mold, fitting said papermaking mold having said pulp layer formed thereon into an impression of a female mold that is shaped in conformity with the contour of a molded article in such a manner that the base of said pulp layer is the first to come into contact with the bottom of said female mold, pressing and deforming said papermaking mold in conformity with the shape of said impression thereby to transfer the shape of said impression onto said pulp layer and to discharge the water content of said pulp layer outside said papermaking mold through the inside of said papermaking mold.

5. A method of producing a pulp molded article which comprises:

immersing a papermaking mold having interconnecting passages that interconnect the outside and the inside thereof and capable of elastic deformation in a pulp slurry, sucking up the water content in the pulp slurry from the outside to the inside of the papermaking mold through said interconnecting passages to form a pulp layer on the surface of said papermaking mold, fitting said papermaking mold having said pulp layer formed thereon into an impression of a female mold, said impression being shaped in conformity with the contour of a molded article, the upper side of said impression being covered with a fluid-permeable and extensible sheet that is fixed to the periphery of said impression, while deforming said extensible sheet by extension so that the base of said pulp layer is brought into contact with the bottom of said impression via said extensible sheet, and pressing and deforming said papermaking mold in conformity with the shape of said impression thereby to transfer the shape of said impression onto said pulp layer to make a molded article.

6. A method of producing a pulp molded article which comprises:

immersing a papermaking mold having interconnecting passages that interconnect the outside and the inside and capable of expansion and contraction in a pulp slurry, with said papermaking mold being adjusted to a prescribed size, to form a pulp layer on the surface of said papermaking mold, contracting said papermaking mold to contract said pulp layer to a prescribed size, fitting the contracted pulp layer into the impression of a female mold composed of a set of splits, expanding said pulp layer as fitted into said impression by a prescribed means to press said pulp layer onto the inner wall of said impression for dewatering.

7. An apparatus for producing a pulp molded article which comprises a papermaking mold having a papermaking part, a papermaking station having a liquid tank containing a pulp slurry, a dewatering station where a pulp layer formed on the outer surface of said papermaking part of said papermaking mold is dewatered by pressing, and a transfer station where the pressed and dewatered pulp layer is transferred to a subsequent station, wherein said papermaking part of said papermaking mold has a core which is capable of elastic deformation under pressing, said dewatering station has a dewatering female mold having an impression in which said papermaking part of said papermaking mold is to be fitted, the contour of said core of said papermaking mold is such that said core with a pulp layer formed on the outer surface thereof, while being pressed in said impression of said female mold undergoes elastic deformation in conformity to the configuration of said impression to fill the space in said impression, and said papermaking station, said dewatering station, and said transfer station are arranged in this order on prescribed positions in an orbit, and said papermaking mold moves from station to station to revolve in said orbit.

8. An apparatus for producing a pulp molded article which comprises a female mold having an impression and a mold to be fitted into said impression, wherein said mold comprises a core of prescribed shape made of an elastically deformable material and having a plurality of holes for fluid passage which interconnect the outside and the inside thereof and a fluid-permeable material covering the outer surface of said core, said fluid-permeable material being capable of securing passages for a fluid in its thickness direction even when pressed and deformed, and the contour of said core of said mold is such that said core with a pulp layer formed on the outer surface thereof while being pressed in said impression of said female mold undergoes elastic deformation in conformity to the configuration of said impression to fill the space in said impression, wherein said fluid-permeable material is detachably disposed on the outer surface of said core, and said mold further comprises a positioning and releasing means which controls placement of said fluid-permeable material on the surface of said core and release of said core from said fluid-permeable material.

* * * * *